US007617768B2

(12) United States Patent
Aho

(10) Patent No.: US 7,617,768 B2
(45) Date of Patent: Nov. 17, 2009

(54) METHOD AND APPARATUS IN CONJUNCTION WITH A SHOE PRESS

(75) Inventor: Erkki Aho, Elimäki (FI)

(73) Assignee: Vaahto Oy, Hollola (FI)

( * ) Notice: Subject to any disclaimer, the term of this patent is extended or adjusted under 35 U.S.C. 154(b) by 74 days.

(21) Appl. No.: 10/589,553

(22) PCT Filed: Feb. 14, 2005

(86) PCT No.: PCT/FI2005/000095

§ 371 (c)(1),
(2), (4) Date: Jun. 7, 2007

(87) PCT Pub. No.: WO2005/080675

PCT Pub. Date: Sep. 1, 2005

(65) Prior Publication Data

US 2007/0256579 A1 Nov. 8, 2007

(30) Foreign Application Priority Data

Feb. 19, 2004 (FI) ..... 20040264

(51) Int. Cl.
*B30B 3/02* (2006.01)
*D21F 3/02* (2006.01)

(52) U.S. Cl. ..... 100/35; 100/156; 162/205; 162/358.1; 162/358.3; 492/7

(58) Field of Classification Search ..... 100/35, 100/118, 121, 153, 155 R, 163 R, 162 B, 100/156; 162/205, 358.1, 358.3, 358.4; 492/6, 492/7; 72/241.6
See application file for complete search history.

(56) References Cited

U.S. PATENT DOCUMENTS 4,713,147 A * 12/1987 Saarinen ..... 162/358.3
5,997,696 A * 12/1999 Gustavsson et al. ..... 162/358.3
6,083,352 A * 7/2000 Snellman et al. ..... 162/358.3
7,172,679 B2 * 2/2007 Gustavsson et al. ..... 162/205

* cited by examiner

*Primary Examiner*—Jimmy T Nguyen
(74) *Attorney, Agent, or Firm*—Birch, Stewart, Kolasch & Birch, LLP

(57) ABSTRACT

A method for changing the distribution of the loading pressure prevailing in the press nip of a shoe press, which shoe press includes a number of adjacent loading elements (K) acting on the press shoe (70), the first end of the elements being supported on the supporting beam (12) of the shoe press and the other end on the press shoe (70). The loading elements (K) are moved in the machine direction (MD) in the space between the press shoe (70) and the supporting beam (12) by acting on the loading element (K) at least at the end adjacent to the press shoe in such manner that the end adjacent to the press shoe is moved in the machine direction (MD) in relation to the press shoe (70), and that the end of the loading element adjacent to the supporting beam (12) can be caused to freely assume a position in relation to the supporting beam (12), preferably at least during the transfer.

18 Claims, 22 Drawing Sheets

METHOD AND APPARATUS IN CONJUNCTION WITH A SHOE PRESS

BACKGROUND OF THE INVENTION

The present invention relates to a method for changing the distribution of the loading pressure prevailing in the press nip of a shoe press, which shoe press comprises a number of adjacent loading elements acting on the press shoe, the first end of said elements being supported on the supporting beam of the shoe press and the other end on the press shoe.

The invention also relates to an apparatus for changing the distribution of the loading pressure prevailing in the press nip of a shoe press, which shoe press comprises a number of adjacent loading elements acting on the press shoe, the first end of said elements being supported on the supporting beam of the shoe press and the other end on the press shoe.

In paper machines, the pressing normally takes place in a press nip between press rollers, the paper web being generally passed through the press nip between water-absorbing press felts which run through the press nip together with the paper web. The length and geometric shape of the press nip have a significant effect on the pressing result.

A very efficient extended press nip is achieved by using a shoe press. The shoe press comprises a slide or press shoe, which typically has a concave pressing surface. The concave pressing surface is arranged against a backing element, such as a backing roll, and an endless belt runs between the slide shoe and the backing roll. In addition, the shoe press comprises an actuating device which presses the slide shoe against the backing roll.

As is known, the actuating device of the shoe press has a row of hydraulic loading cylinders under the show. Typically, the press shoe must be set according to the surface of the backing roll and bend according to the curvature of the backing roll surface. The press shoe must also transmit the horizontal nip forces to the supporting structures of the shoe roll. The press shoe typically assumes inside the shoe roll a spatial shape that the loading cylinder under it has to effectively follow.

On the other hand, the supporting structure under the loading cylinder bends both in the longitudinal direction MD and in the transverse direction CD of the machine, so that the supporting beam also assumes a spatial state.

In the middle part of the machine the distance between the press shoe and the supporting beam is different than in the edge areas of the machine. As a result of the overall arrangement, the opposite ends of the loading cylinder continuously assume different spatial states and the middle part is stretched due to the deflections.

Patent specification FI 103591 discloses an arrangement for moving the shoe of a shoe press.

Patent specification U.S. Pat. No. 6,083,352 discloses another approach to the loading and pull-back of the shoe of a shoe press. Solutions based on adjustment of the loading cylinder and later solutions based on adjustment of tilt for this type of cylinder are different alternatives of eccentricity. In the solution in question, the cylinders can not be mounted very close to each other due to the fastening clamps, so the loading capacity per meter of machine width is not the best possible.

Specification EP 737776 discloses a solution wherein the frame of the shoe roll contains a machined space for a loading element. A piston is fixed to the bottom of the machined space. A cylinder moves on the piston. The cylinder is continuously urged by a spring against the shoe part. The pressure inside the piston and cylinder produces the actual loading pressure. The shoe part can move in relation to the pistons. The cylinder can turn in relation to the piston.

Specification U.S. Pat. No. 5,935,385 discloses a corresponding structure in which the cylinder can move into the frame of the shoe roll in the machined space.

Specification EP 74+0016 further discloses a simple approach to solving the problem in question. In this case, the frame of the shoe roll forms a cylinder block in which the pistons are movably mounted. The upper end of the pistons leans against the loading shoe of the shoe roll, and the loading shoe can move freely in relation to the cylinder. The piston is held against the bottom of the loading shoe by means of a spring.

In specification U.S. Pat. No. 6,093,283, the piston is fixedly secured either to the loading shoe or to the frame of the shoe roll, and correspondingly the cylinder can move in relation to the shoe roll frame or the loading shoe.

A problem with all the prior-art solutions is that they provide only limited possibilities of adjustment. In addition, to make an adjustment, it has been necessary to dismantle the whole shoe press structure and only then carry out the adjustment. In prior-art solutions, typically one half of the loading element is fixedly locked to the supporting structures or to the press shoe. This imposes limitations on the adjustment.

The object of the present invention is to achieve a completely new type of solution for the loading unit of a shoe press that will allow the drawbacks of prior art to be avoided. Another object of the invention is to achieve a shoe press loading unit that will make it possible e.g. to vary the distribution of compression of the shoe press in a versatile manner. A further object of the invention is to achieve an adjustment solution that can be used without dismantling the structure of the shoe press.

BRIEF DESCRIPTION OF THE INVENTION

The method of the invention is characterized in that the loading elements are moved in the machine direction in the space between the press shoe and the supporting beam by acting on the loading element at least at the end adjacent to the press shoe in such manner that the end adjacent to the press shoe is moved in the machine direction in relation to the press shoe, and that the end of the loading element adjacent to the supporting beam can be caused to freely assume a position in relation to the supporting beam, preferably at least during the transfer.

The apparatus of the invention is characterized in that the apparatus comprises means for moving at least the end of the loading element adjacent to the press shoe in machine direction, and means for reducing lateral forces between the supporting beam and the end of the loading element adjacent to the supporting beam.

The solution of the invention has numerous significant advantages. The pressure distribution or "tilt" prevailing in the press nip can be adjusted by the solution of the invention in a single row solution from outside the machine or alternatively in a solution of more economical cost also from inside the machine in a very simple manner. The solution allows an adjustment to be made without dismantling the structures of the machine. The adjustment can be easily automated.

At the same time, we have also taken into account the possibility of turning the roll upside down independently of the loading direction. The structural solution provides an overall arrangement in which the transverse thermal expansion of the machine is effectively taken into account while ensuring that the press shoe is set according to the shape of the backing roll.

BRIEF DESCRIPTION OF THE FIGURES

In the following, the invention will be described in detail with reference to an example and the attached drawings, wherein.

DETAILED DESCRIPTION OF THE INVENTION

Figure 1:
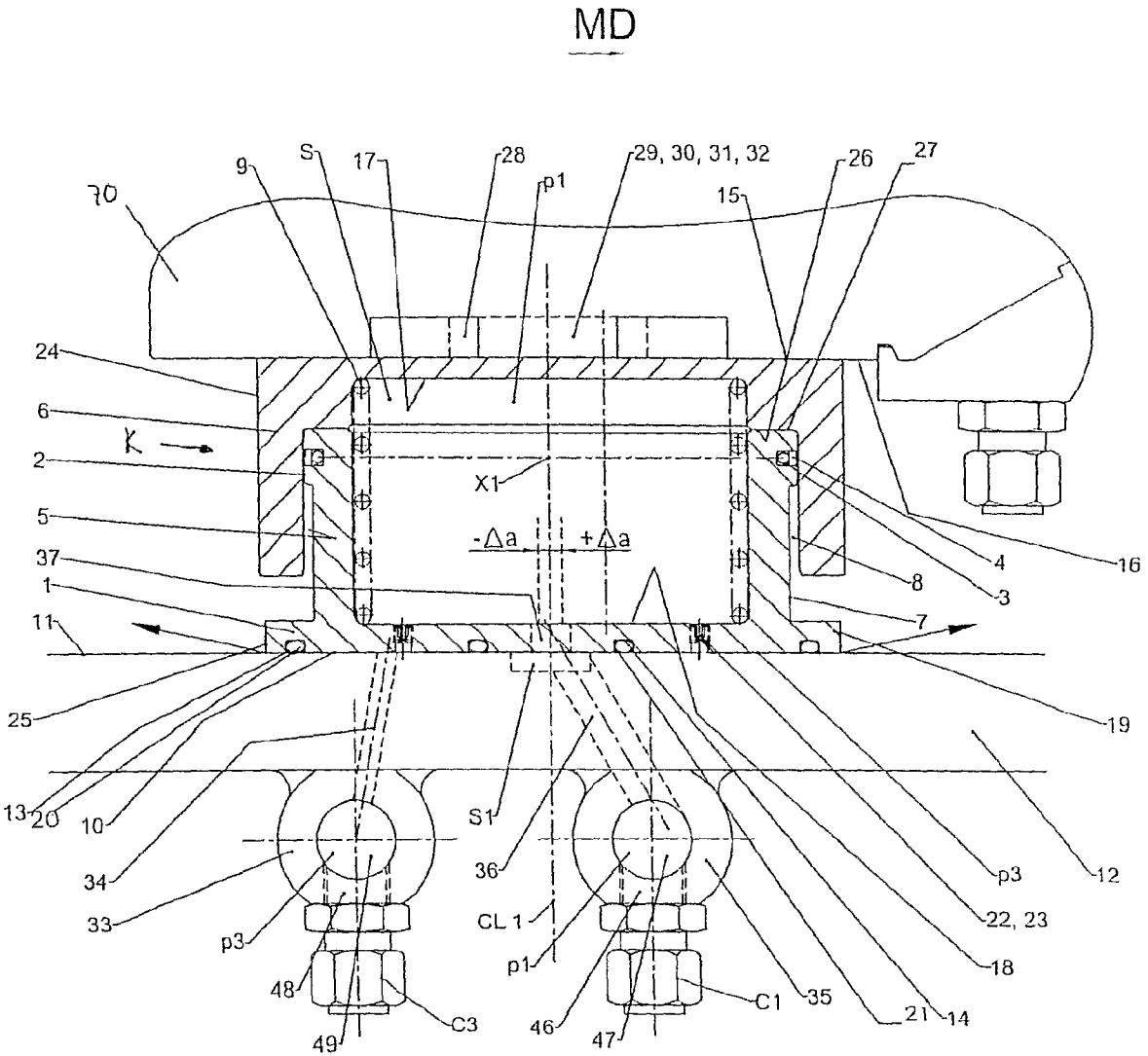
FIG. 1 presents a cross-sectional view of a loading device according to the invention in a low position.

The invention concerns a method for changing the distribution of the loading pressure prevailing in the press nip of a shoe press, wherein the shoe press comprises a number of adjacent loading elements K acting on the press shoe 70, the first end of said elements being supported on the supporting beam 12 of the shoe press while the second end meets the press shoe 70. The loading elements K are moved in the machine direction MD in the space between the press shoe 70 and the supporting beam 12 by acting on the loading element K at least at the end adjacent to the press shoe in such manner that the end adjacent to the press shoe is moved in the machine direction MD in relation to the press shoe 70, and that the end of the loading element adjacent to the supporting beam 12 can be caused to freely assume a position in relation to the supporting beam 12, preferably at least during the transfer.

According to the method, the loading element K is acted on directly or via a transmission.

According to a preferred embodiment, the loading element is acted on by at least one transfer element, most suitably a bar element 225, 226, which is moved in the transverse direction CD of the machine.

According to another embodiment, the loading element K is acted on via a transmission, wherein an eccentric element acts on the loading element while the eccentric element is acted on by a bar element.

According to a further embodiment of the invention, the loading element is acted on by an eccentric toothed gear 186, which is rotated by a toothed bar element 185.

According to an embodiment, a projection part 28 formed at the end of the loading element K adjacent to the press shoe is moved between guide surfaces 31, 32 extending in the machine direction MD, while the transfer elements acting in the transverse direction of the machine produce a transfer movement in the machine direction MD.

According to an embodiment, a pressure medium is supplied into the space between the supporting beam 12 and the end of the loading element K adjacent to the supporting beam to reduce lateral forces.

One embodiment allows adjustment of the distribution of loading pressure during operation of the machine. In this case, the distribution of loading pressure can be adjusted continuously on the basis of measurement data.

The press beam 70 is acted on by the loading unit K, which comprises a cylinder-piston unit. This will be dealt with in more detail later on.

The invention also relates to an apparatus for changing the loading pressure prevailing in the press nip of a shoe press, which shoe press comprises a number of adjacent loading elements acting on the press shoe 70, the first end of said elements being supported on the supporting beam 12 of the shoe press while the second end meets the press shoe 70. The apparatus comprises means for moving at least the end of the loading element K adjacent to the press shoe 70 in the machine direction MD, and means for reducing lateral forces between the supporting beam and the loading element end adjacent to the supporting beam 12.

According to an embodiment, the means for moving at least the end of the loading element K adjacent to the press shoe 70 comprise at least one transfer element 225, 226, 185 arranged in conjunction with the press shoe 70, which transfer element is movable in the transverse direction of the machine and by means of which a backing element 28 of the loading element K is moved directly and/or via a transmission mechanism. Arranged in conjunction with the press shoe 70 are guide surfaces 31, 32 or guide elements for guiding the motion of the loading element, especially to make it move in the machine direction MD. The transfer element 225, 226 is provided with a guide surface 227, 228; 235, 236 and the loading device is provided with a mating surface 229, 230, 161 so that the guide surface moves the loading device by the mating surface.

The transfer means moving the loading element K typically comprise actuating devices arranged in or near the end area of the press shoe 70.

The loading element K is typically a cylinder-piston combination. This embodiment will be described hereinafter in greater detail.

In one embodiment, the transfer means comprise two bar elements 225, 226, which together influence the position of the loading element in the machine direction MD.

In another embodiment, the transfer means consist of an eccentric wheel, such as an eccentric toothed gear 186, which is driven by a toothed bar element 185 connected to the actuating devices.

The means for reducing the lateral forces between the supporting beam and the loading element end adjacent to the supporting beam comprise at least one conduit for conveying a pressure medium into the space between the supporting beam and the loading element.

The adjusting devices are preferably arranged in a space formed in the press shoe. In a loading situation, the loading element K locks the adjusting elements, which typically according to the invention are located between the loading element K and the press shoe 70, in place. Some embodiments of solutions according to the invention are further described in greater detail in the following.

In FIG. 1, the piston 1 has an outer surface 2 of a curved shape in the portion placed against the inner surface of the cylinder space, preferably a substantially spherical shape, i.e. forming part of a spherical surface. Provided on the lateral surface 2 are sealing means for sealing the piston against the inner surface 5 of the cylinder 6. The sealing means comprise a sealing groove 3 and a seal 4 arranged in the groove. The piston 1 has a recessed outer surface. Due to the difference between the outer surface 7 of the recessed part of the piston and the piston surface 2 facing against the inner surface 5 of the cylinder, there is formed between the inner surface of the cylinder and the outer surface of the piston a space 8 that enables the cylinder 6 to turn about point X1. Point X1 is typically at the center of surface 2. Placed between the piston 1 and the cylinder 6, typically in the chamber space S between them, is a pre-loading element, such as a spring 9, which causes the outer surface 10 of the piston 1 to be pressed against the surface 11 of the supporting beam 12. Correspondingly, the spring 9 presses the surface 15 of the cylinder 6 as the surface 16 of the loading shoe. Depending on the direction of the loading, the spring 9 is not necessarily needed. The spring is tensioned against surface 17 of the cylinder 6 and surface 18 of the piston 1.

The piston 1 has a flange 19 at the end adjacent to the supporting beam 12. Inside the flange 19, on surface 10, is a groove 20 for a seal 13. In addition, surface 10 is provided with a groove 21 for a seal 14. A pre-loading element, typically a spring 9, simultaneously precompresses the seals 13 and 14 placed between the piston and the supporting beam. The diameter of seal 13 is chosen specifically for each case. If the main load pressure p1 applied via conduit C1 is to be used to load surface 10 against surface 11, then a seal 13 having a diameter smaller than the diameter of cylindrical surface 5 is selected. The diameter of seal 13 can also be so chosen that oil will leak through between surfaces 10 and 11. In this case, as compared to pressure p1, a balanced pressure p3 corresponding to a leakage will be set up between seals 14 and 13.

The loading unit is provided with flow channels for a pressure medium. From surface 18 of the piston 1, one or more holes 22, preferably threaded holes, have been made to surface 10, typically by drilling. Mounted in the threaded holes 22 are nozzle pieces 23. The nozzle pieces 23 may be provided with a back-pressure valve to prevent flow from surface 10 into the space inside the piston 1. The pressure medium, such as oil, flows from inside the piston 1 via the nozzle pieces 23 into the space between surfaces 10 and 11. The aperture inside the nozzle 23 is varied to achieve a desired flow rate.

The diameter of the outer surface 24 of the cylinder 6 is substantially equal to the diameter of the outer surface 25 the piston 1. In the low position, surface 26 of the piston 1 touches surface 27 of the cylinder.

Figure 7:
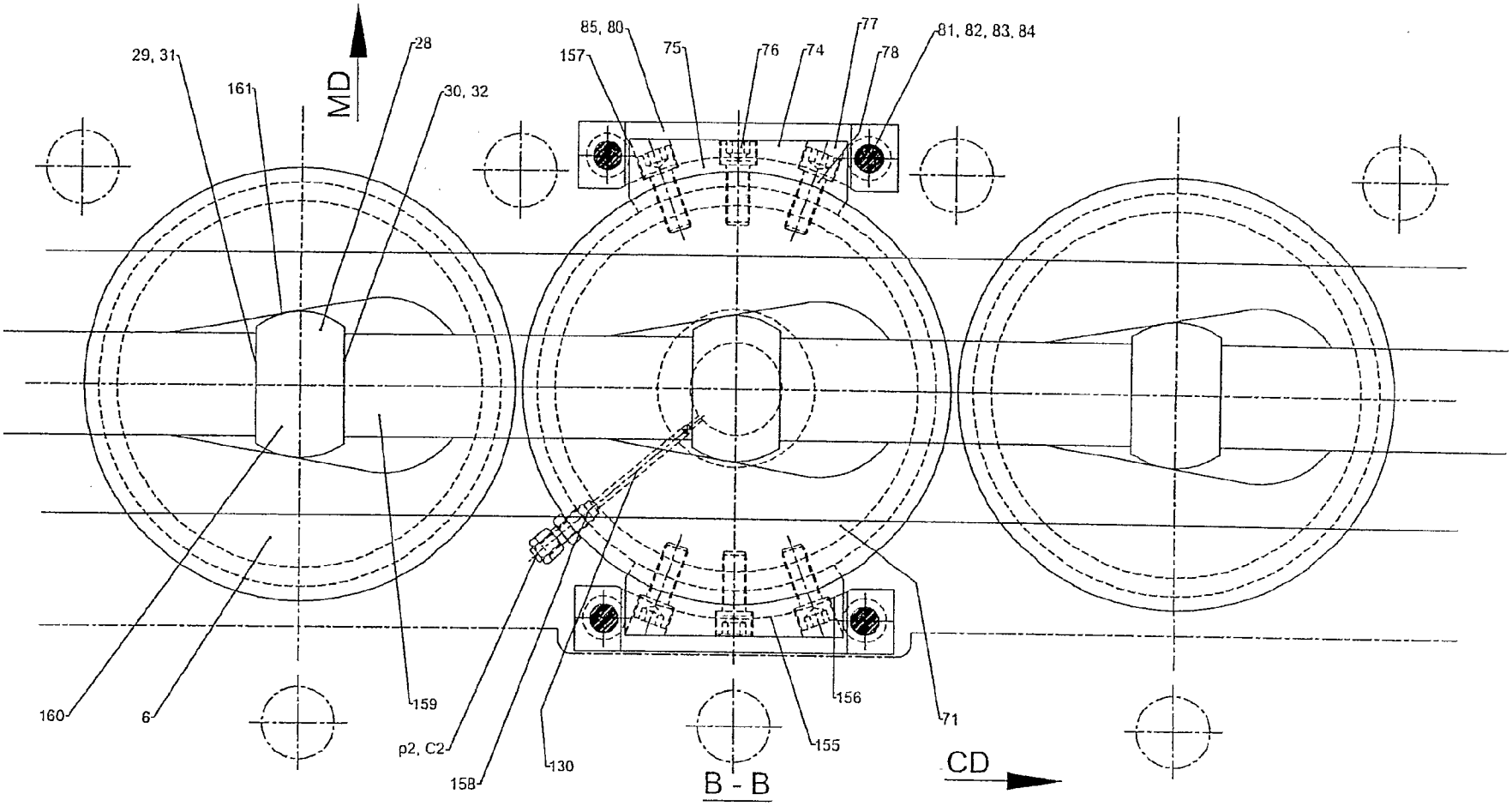
FIG. 7 illustrates the fastening of the loading device provided with a releasing/lifting device below the shoe, in cross-sectional view along line B-B in FIG. 5.

On the surface 15 of the cylinder 6 adjacent to the loading shoe is a guide element, such as a projection 28, see also FIG. 7. Formed in the projection is at least one guide surface, typically two guide surfaces. In the figure, the guide surfaces consist of two sides 29 and 30, which have been machined to make them straight and which, in an operating situation, extend in the direction of the MD axis of the machine. Surfaces 29 and 30 are in contact with the walls 31 and 32 of the groove inside the loading shoe.

Guided by the projection 28, the cylinder 6 can move in the MD direction of the machine in the groove of the loading shoe through a distance of $\pm\Delta a$ in relation to the basic center line CL1 of the cylinder.

The piston 1 follows the motion of the cylinder 6 in the machine direction MD. The cylinder 6 can be moved when it is in the low position, but the structure can also be adjusted in the operating state of the machine, depending on the selected mode of control/adjustment. Seal 14 may be of a type capable of bi-directional sealing with different pressures inside and outside, and likewise seal 13.

During movement of the cylinder 6, the piston 1 can be assisted by a separate pressure p3. The pressure p3 is supplied via a conduit C3 into a manifold 33 and further through a channel bore 34 into the space between surfaces 10 and 11. The action of the pressure will now be applied to the area between the seals 13 and 14, and it can be partly discharged via the nozzles 23 into the space S defined by the inner surfaces of the cylinder 6 and piston 1.

When the cylinder is in the low position, the pressure p1 in space S is 0 and the overpressure is discharged through conduit C1 into the tank. Alternatively, when the nozzle 23 contains a back pressure valve, pressure p3 can not be discharged into cylinder 1. The conduit C1 is connected to a manifold 35. In an operating situation, the pressure p1 is conveyed from the manifold 35 through a channel 36 into space S1.

Between surfaces 18 and 10 of the piston 1 is a channel bore 37 through which the pressure p1 can be discharged from space S1 into space S. In an operating situation, the cylinder 6 and the piston 1 move further apart from each other and assume spatial positions relative to each other.

The arrangement may comprise one or more conduits C1 and C3, and likewise one or more manifolds 33 and 35, e.g. according to zone divisions. The manifolds may be welded onto the supporting beam of the shoe roll in a pressure-tight manner. Space S1 may be of an oval shape or a round machined space that permits the piston 1 to move in the machine direction MD. The manifold 35,33 has a counterthread 46,48 for the pressure conduit C1 and C2. The main channel 47,49 is inside the manifold 35,33. Distribution channels 36,34 start from the main channels 47,49. The conduits C1 and C3 are connected to an external oil supply system, or to a corresponding pressures system (not shown in the figure). The ends of the distribution channels 33,35 are plugged with a separate piece (not shown in the figure), to the extent necessary because of flushing and inspection requirements. In an operating situation, the flow through conduit C3 into the tank is closed and pressure p3 follows pressure p1.

Figure 2:
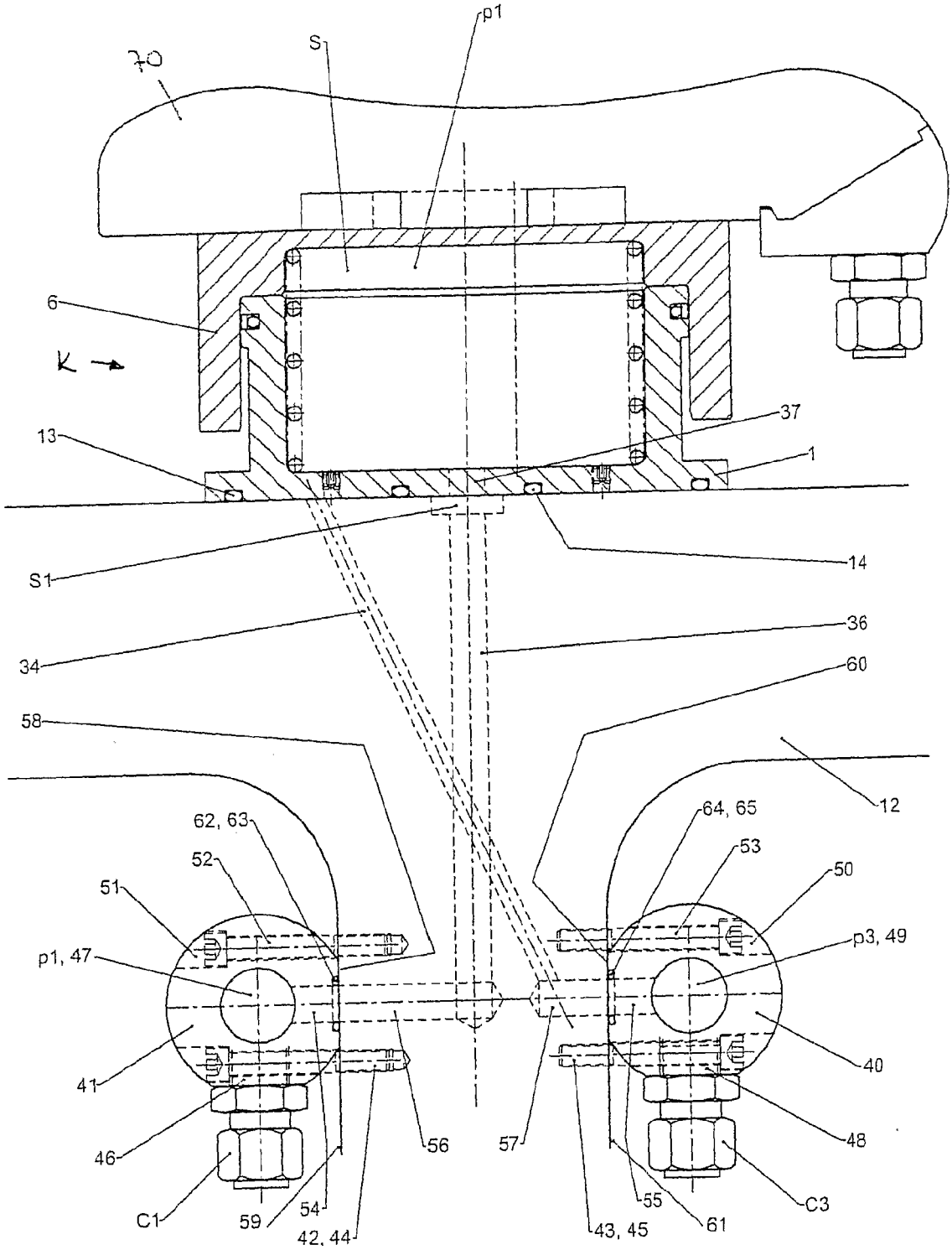
FIG. 2 presents a cross-sectional view of an embodiment of the locking device of the invention in a low position.

FIG. 2 illustrates a situation where the shape of the supporting beam 12 of the shoe roll differs that of the supporting beam in FIG. 1. Typically, the supporting beam in FIG. 2 is made by casting or forging. In this case, the manifolds 40 and 41 are secured to the shank portion of the supporting beam 12. The manifolds 40 and 41 are divided into sections, e.g. according to zone adjustment. The number of oil supply conduits C1 and C3 is one or more, and likewise that of manifolds 40,41. The supporting beam 12 is provided with counter-threads 42, 42 for the manifold fixing bolts 44, 45. The manifolds 40 and 41 are provided with counter-threads 48 and 46 for the conduits C3, C1. The manifolds 40 and 41 contain the main channels 47, 49 for pressures p1 and p3. Provided in the manifolds 40 and 41 are machined counter-sunk holes 51, 50 and clearance holes for the securing screws 44, 45. The main channels 47, 49 are connected via channel bores 54, 55 to the channel bores 56, 57 in the supporting beam. The distribution channels 41, 40 are sealed by surfaces 58, 60 to the surfaces 59, 61 of the supporting beam 12.

Placed between the supporting beam 12 and manifolds 40 and 41 are seals 62, 64, and the manifolds 40 and 41 are provided with sealing grooves 63, 65 corresponding to the seals 62, 64 around the bores 54, 55. From manifold 40, pressure p3 is conveyed via main channel 49 via bores 55, 57, 34 into the annular space between the seals 13 and 14. From manifold 41, pressure p1 is conveyed from main channel 47 via bores 54, 56, 36 into space S1 and further via bore 37 into space S. Depending on the load situation, the cylinder 6 and the piston 1 additionally have air conduit bores not shown in the figure. Oil supply into channels 56,57 can also be implemented using only a pipe structure without a separate distribution channel. In this case, channel portions 56,57 are provided with inner threads and a separate coupling part for attaching the oil supply pipe to the channel is secured to each thread. According to the zone division, the main oil pipe is divided by means of a T-coupling into lateral branches and further to the couplers of channels 56,57.

Figure 3:
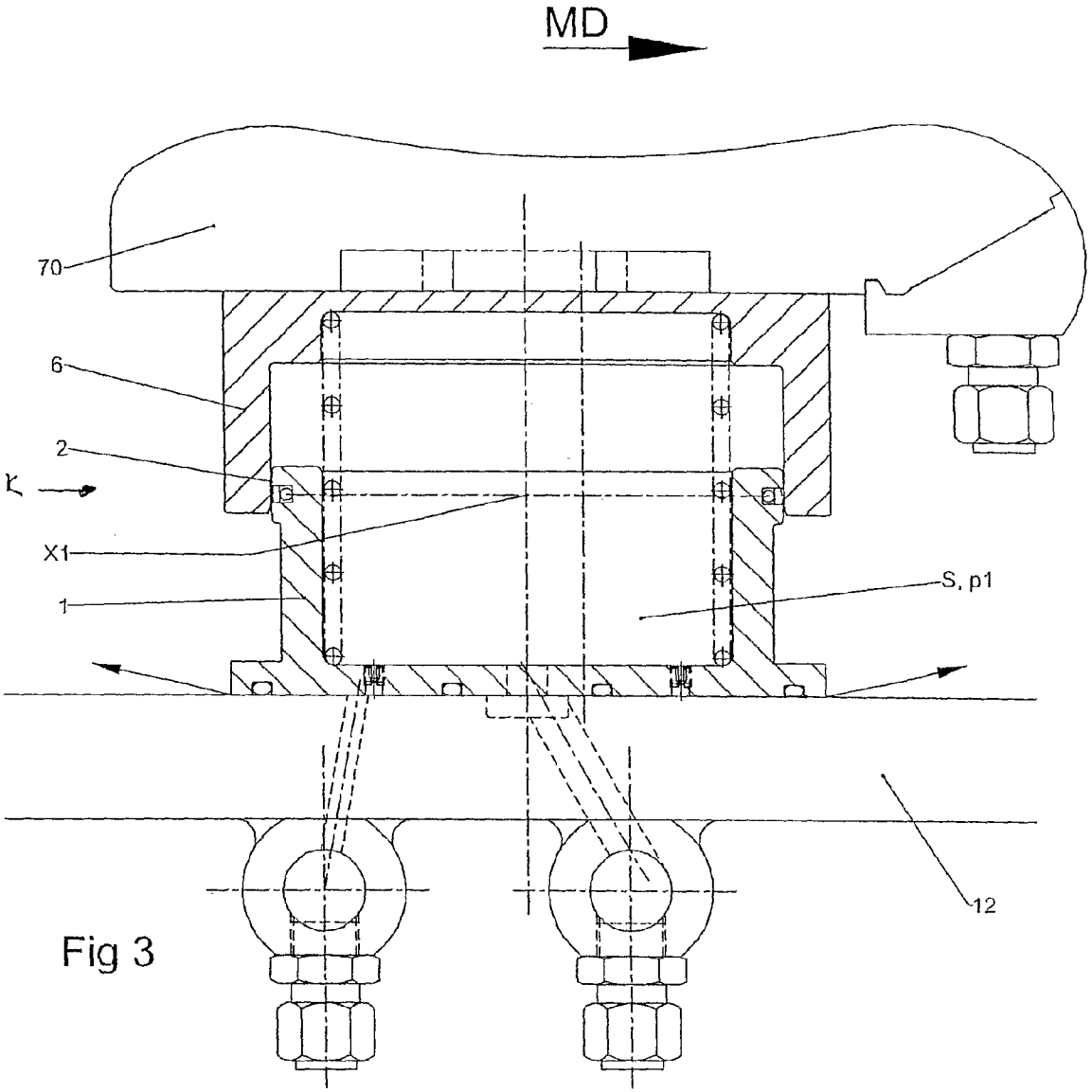
FIG. 3 presents a cross-sectional view of a loading device according to the invention in a high position.

FIG. 3 illustrates a situation where the loading element according to FIG. 1 is in the high position. The cylinder 6 has risen to its maximum position in relation to the piston 1. In this situation,

- the cylinder can freely follow the movements of the press shoe 70
- the shoe 70 is supported from the sides oriented in the CD direction, so there occurs but little tilting of the cylinder 6 in the MD direction in relation to the center X1 of the spherical surface 2
- due to thermal motion and loading, the cylinders 6 follow the motion of the loading shoe 70, so there occurs more extensive tilting of the cylinders 6 in the CD direction in relation to the center of the spherical surface 2 than in the MD direction.
- on the other hand, the pistons 1 can follow the motion of the cylinders in the CD direction of the machine, especially if there is a pressurized sliding film layer between the supporting beam 12 and the pistons 1.

Figure 4:
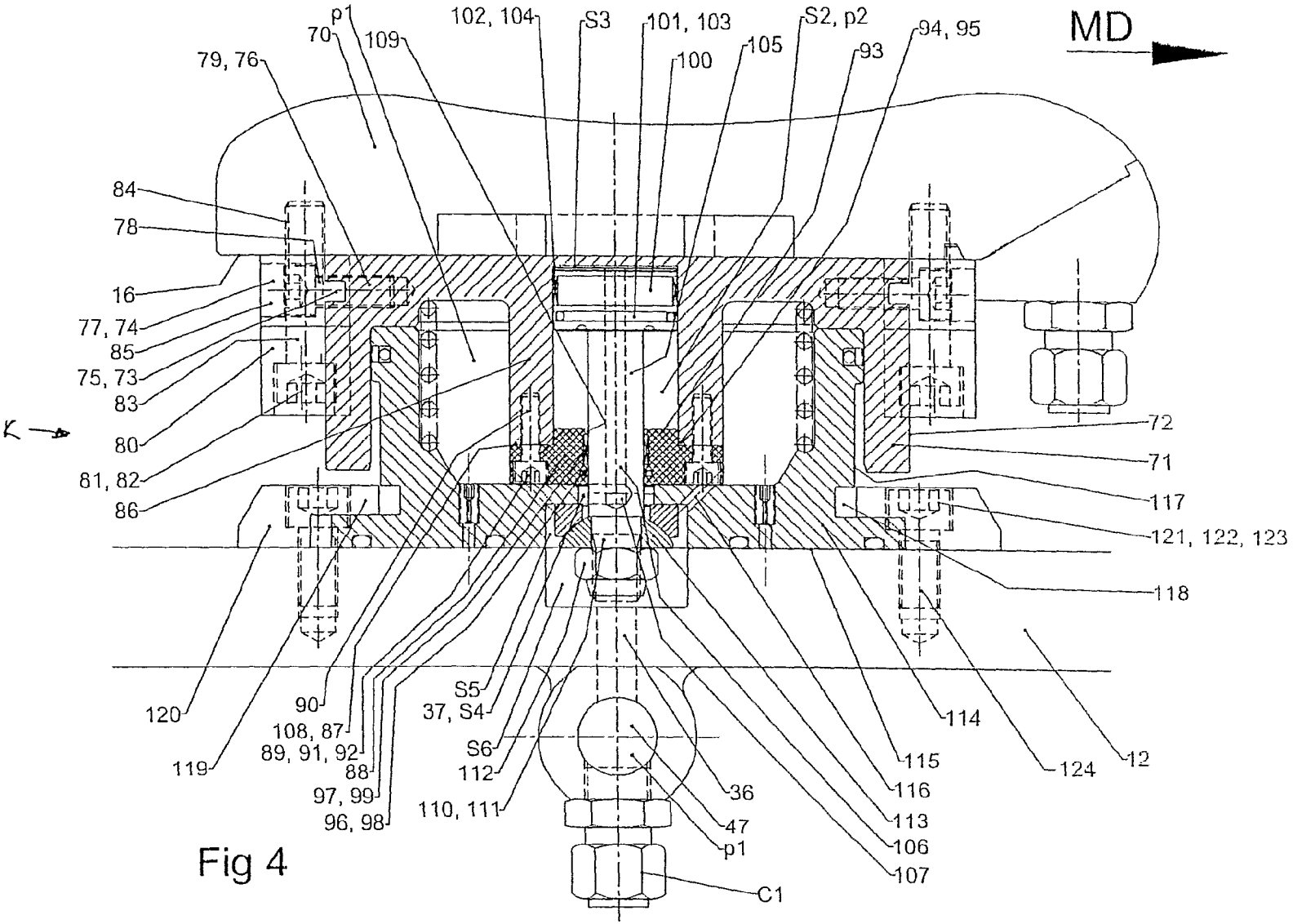
FIG. 4 presents a cross-sectional view of a loading device provided with a releasing/lifting device in a low position.

FIG. 4 presents a second embodiment of the loading device of the invention. The solution according to the second embodiment comprises a release/lifting cylinder. Cylinder 71 contains another cylinder tube 86 inside it. A cover 88 is fastened onto cylinder 86 by means of fastening elements 89. Threaded holes 90 for the fastening elements 89 are provided in the surface 87 of the cylinder. The cover 88 is provided with machined counter-sunk holes 91 and clearance holes 92 for the fastening elements 89. Machined inside the cylinder 86 is a space S2, into which a guide ring of the cover 88 partly sinks and at the same time centers the cover 88 with the cylinder tube 86. The guide ring 93 together with surface 87 and the machined space S2 inside the cylinder 86 forms a space 94 in which a seal 95 is fitted. The cover 88 is provided with a seal 96 and a guide ring 97 and corresponding grooves 98, 99. Inside the cylinder 86 is a piston 100, which remains substantially immovable as cylinder 86 is moving in step with cylinder 72. The piston 100 is provided with a seal 101 and a guide ring 102 and corresponding grooves 103, 104. The piston 100 is guided and sealed by its outer surface according to the outer surface of space S2. In addition, the cylinder 86 contains a space S3 above the piston. The piston rod 105 contains one or more channel bores 106, 107. When the cylinder 86 moves upwards or downwards, oil will flow from space S4 via the channels 106, 107 into space S3, so the pressure in spaces S4 and S3 is the same. The cover is sealed by its surface 108 against surface 87 of the cylinder 86, and likewise by its inner surface 109 against the outer surface of the piston rod 105. The piston 100 and the piston rod 105 remain substantially immovable as the cover 88 is moving upwards and downwards with the cylinder 86. The piston rod 105, the guide part 93 of the cover 88, the piston 100 and the inner surface of cylinder 86 define a space S2 into which oil is supplied via conduit C2. See FIGS. 5 and 7.

In normal operation, space S2 is at the same pressure with spaces S3, S4. The piston rod 105 is narrowed at one end by one or more axial indentations 110. One end of the piston rod 105 is provided with a bolt thread 111 for a lock nut 112 to be screwed onto it to lock the spherical bearing 113 against the axial shoulder. Piston 114 is in principle similar to piston 1. Machined in surface 115 of the piston is a cylindrical space S5. From space S5 there is a bore 37 corresponding to that in piston 1. The piston rod 105 and bore 37 define space S4. From space S5 one or more channel bores 116 lead to the space inside the piston 114. The supporting beam 12 is provided with a cylindrical machined counterboring S6 for a lock nut 112 corresponding to space S5. The spherical bearing 113 can slide in space S5 according to cylinder 86 and 71, as well as turn in step with cylinder 86 and 71. In normal operation, the spherical bearing 113 and the piston as well as the piston rod 105 are in an unloaded state as pressure p1 prevails everywhere inside the structure. In an operating situation, the pressure p1 conveyed via conduit C1 into the main channel 47 and further through bore 36 into space S6, which communicates with space S5. From space S5, the pressure p1 is conveyed via bores 116 into the space inside piston 114. Inside the piston, the oil is conveyed into space S4 and further via channels 106 and 107 into space S3.

In the operating situation, the pressure p2 in space S2 is the same as pressure p1. The outer surface 117 of piston 114 is provided with a groove 118 which can receive the projection 120 of a bracket 119 as the piston 114 is moving on the supporting beam 12.

The bracket 120 is provided with machined counterborings 121 and clearance holes 122 for a fastening element 123. The supporting beam 12 is provided with threaded holes 124 for the fastening element 123. The bracket 120 is fastened to the supporting beam 12 by means of the fastening element 20 123. The piston 114 is movably mounted on the surface of the supporting beam, with the flange remaining under the bracket 120 and the projection 119. In a releasing and lifting situation, the cylinder 71 is held fast on the loading shoe 70 and correspondingly the piston 114 is held fast on the supporting beam 12. Due to the action of pressure p2 in space S2 when the loading shoe 70 is upside down, the loading shoe rises upwards.

The outer surface 72 of cylinder 71 is provided with an annular groove 73 into which the projection 75 of a holding block 74 is set. See also FIG. 7. Arranged radially in the holding block 74 are counterborings 77 and clearance holes 78 for fastening screws 76. Arranged radially in the cylinder 71 are mating threads 79 for the fastening screws 76. In the area of the fastening screws 76, the bracket 75 is notched as far as necessary. Holding block 80 is provided with machined counterborings 81 and clearance holes 83 for securing bolts 82. The loading shoe 70 is provided with corresponding threaded holes 84 for the securing bolts 82. Holding block 80 has a machined space 85 for the fastening part 74. The cylinder 71 is secured to the surface 16 of the loading shoe by means of fastening elements 74, 80 and fastening screws 76, 82. The cylinder 71 can move in the machine direction MD in relation to the loading shoe 70, the holding blocks 74, 80 are so designed as to permit movement in the MD direction. The parts 74, 80 are so designed as to allow some movement of the cylinder 71 in the CD direction of the machine, too.

Figure 5:
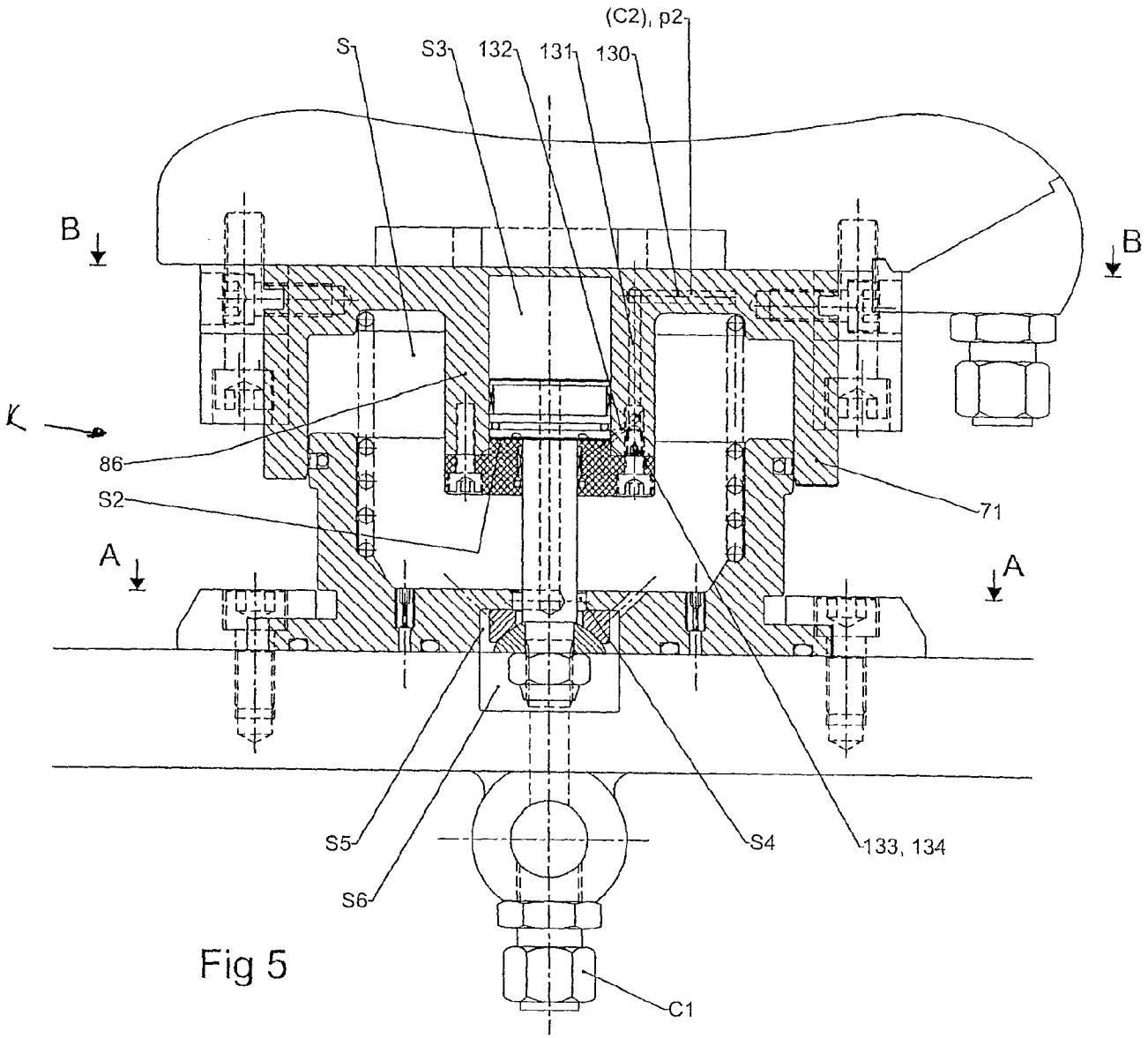
FIG. 5 presents a cross-sectional view of a loading device provided with a releasing/lifting device in a high position.

In FIG. 5, the cylinder 86, 71 has channel bores 130, 131, 132 inside it. Via conduit C2, a pressure p2 is conveyed into space S2 through the channels 130, 131, 132. Cylinder 86 is provided with a threaded hole 133 for a plug 134. In the figure, the releasing/lifting cylinder is completely in the high position. The cylinder assembly has one or more venting conduits, which are not shown in the figure. In an operating situation in normal conditions, spaces S2-S6 and S are at the same pressure, the conduits C1 and C2 being connected to an external system so that the pressures and volume flow rates in different spaces correspond to the desired operating condition. Space S expands, and so does space S3, while space S2 is reduced almost to its minimum size according to the distances of motion of the cylinder.

Figure 6:
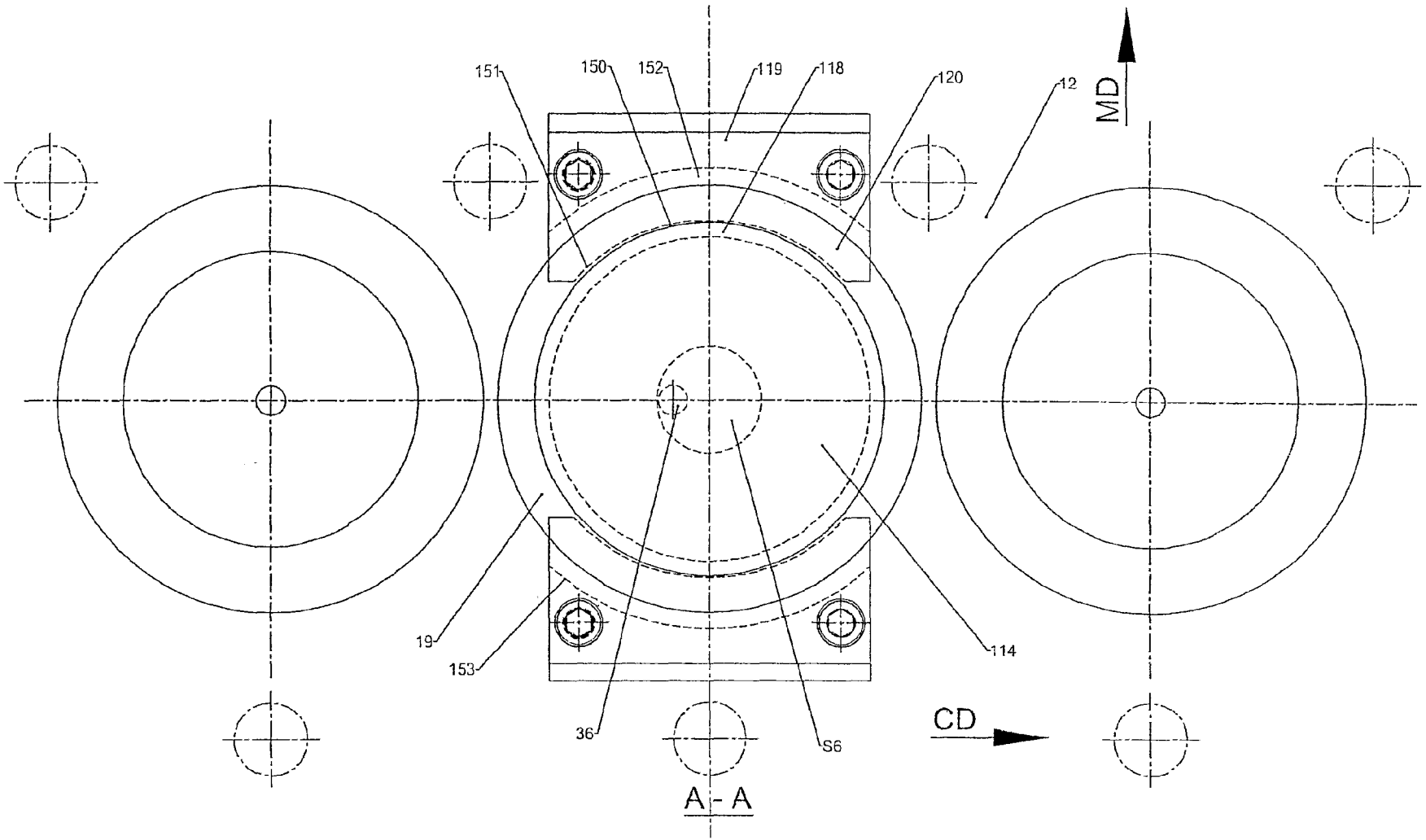
FIG. 6 illustrates the fastening of loading device provided with a releasing/lifting device on the surface of a supporting beam, in cross-section along line A-A in FIG. 5.

In FIG. 6, loading units are placed in a row on a supporting beam 12. Most of them are part of a basic structure without a release and pull-back function. The piston 114 of the release and pull-back unit rests on the press shoe supporting beam 12 or alternatively hangs from the supporting beam. The projection 120 of the bracket 119 has been machined into a curved shape to fit the groove 118. The curvature 150 changes at its ends to a more extended radius 151 that permits thermal motion of the piston 114 in relation to the supporting beam 12. The bracket 119 has a space 152 for the flange 19 of the piston 114. The space 152 is curved at its ends in the same way with a larger radius 153 than the radius 151 of the projection. The supply channel 36 leading into the oil supply space S6 is placed eccentrically relative to the supply space S6. With this solution, free movement of the piston 114 on the supporting beam 12 due to thermal motion and adjustment is achieved, and at the same time the piston 114 allows the loading shoe to be lifted.

FIG. 7 illustrates the situation on the surface 16 of the loading shoe, without showing the shoe part 70 itself. Placed under the loading shoe is a row of loading units, most of which is part of the basic structure without release and pull-back action. The pull-back cylinder 71 is secured to the loading shoe by means of brackets 80. The bracket 80 is so shaped that it has a curvature 155 on the side facing towards the cylinder 71. Towards the extremities the radius 156 of the curvature 155 changes so as to allow thermal expansion of the cylinder 71 in the extreme position. According to adjustment, the cylinder 71 can move in the machine direction MD in relation to the brackets 80. Between the brackets 74 and 80 in the CD direction of the machine, a small clearance 157 allowing thermal motion of the cylinder 71 is provided. The cylinder 71 has a release conduit C2 and a fastening bore 158 corresponding to the conduit. In a release situation, a pressure p2 is supplied via conduit C2 into the cylinder inside cylinder 71. Both the normal loading cylinder and the release cylinder 6, 71 are provided with a guide projection 28, whose outer surface is 161. Surface 161 may be cylindrical or curved or it may also have other suitable shapes. Between each cylinder 6, 71 there remains an unbroken neck 159 of the loading shoe. In the area of the projection 28, a corresponding area has been machined away from the loading shoe. In normal operating conditions, the projection 28 is supported by its surface 160 on the loading shoe. During normal operation, the cylinders 6, 71 are immovable in relation to the loading shoe and follow the spatial position of the loading shoe.

Figure 8:
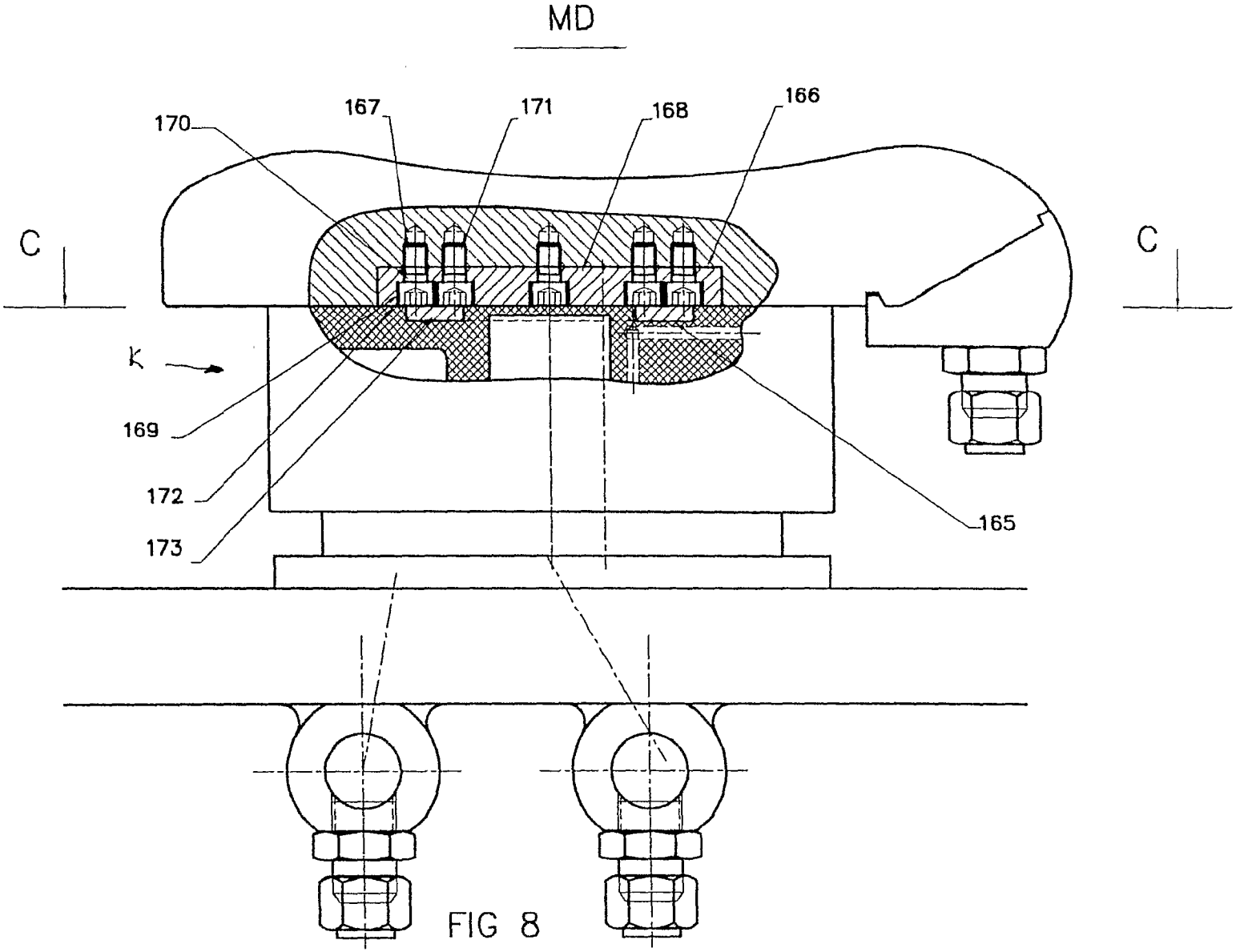
FIG. 8 presents a second embodiment of the solution of the invention, FIG. 9*a*) presents a detail of FIG. 8 in the form of a section C-C, FIG. 9*b*) presents an adjusting ring.

FIG. 8 presents a cross-section of structure in which the loading shoe has an annular groove 165 machined at its upper end and correspondingly the shoe beam has a cylindrical space 166 machined inside it. Machined on the bottom of the cylindrical machined space 166 is a threaded hole 167. Fitted in the machined space 166 is a separate circular adjusting plate 168. The adjusting plate is provided with counterborings 169 and clearance holes 170 for fastening screws 171. On the surface 172 of the adjusting plate is a machined projection 172 which fills space 165. The adjusting plate 168 is fastened to bottom of the machined space 166 by means of fastening screws 171.

This construction is typically only applicable for use in a nip structure below the nip point, where the shoe roll is below and the backing roll above, preferably on a vertical line. In this structural solution, in addition to moving in the lateral direction MD, the loading cylinder also moves the transverse direction CD of the machine. The structure is economical to manufacture, but the adjustment situation requires removal of the shoe beam from the machine and a "belt change situation".

Figure 9:
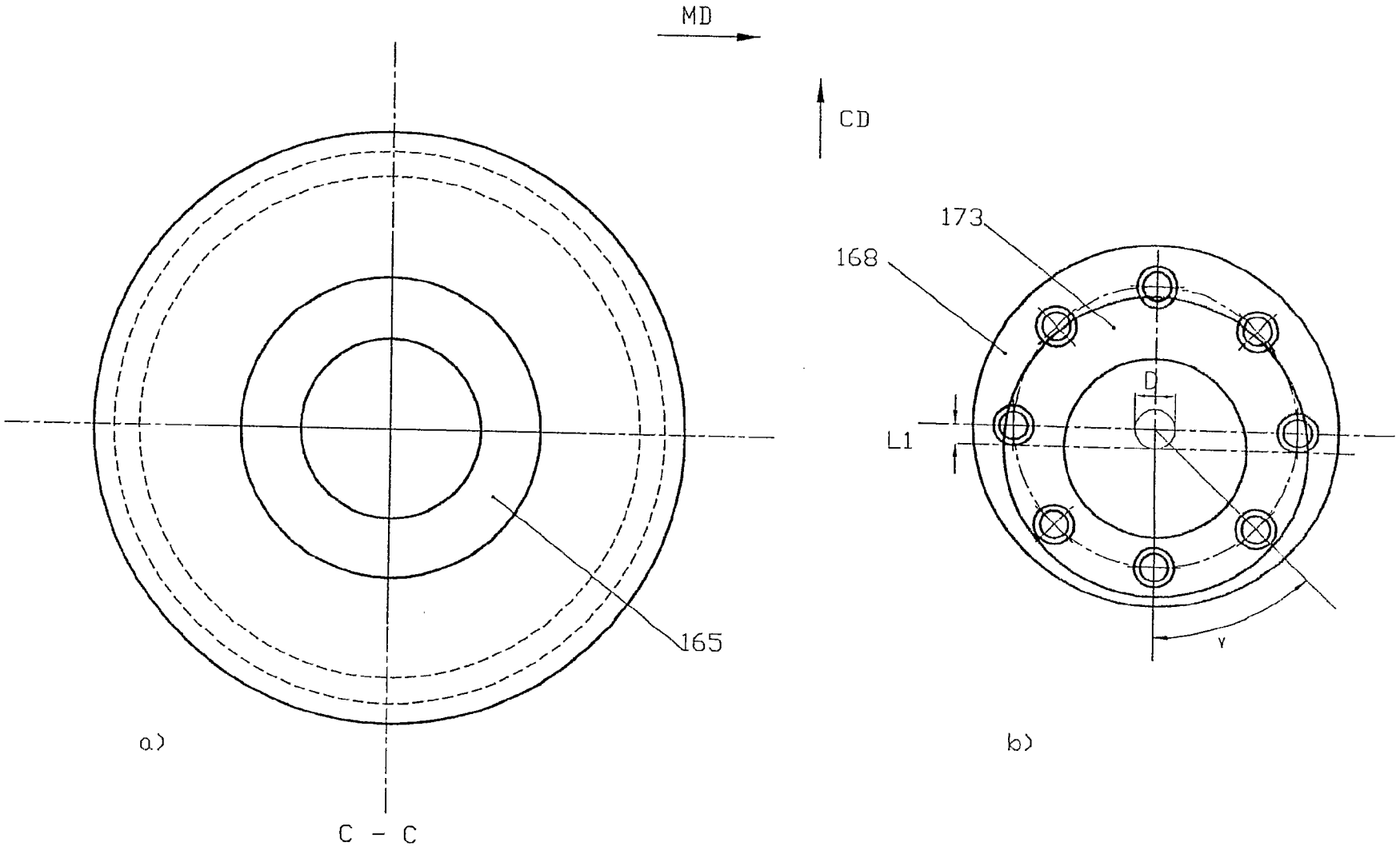

In the cross-section C-C in FIG. 9 *a*), that the groove 165 is concentric with the center of the loading cylinder.

In FIG. 9 *b*) it can be seen that the adjusting plate 168 its machined shoulder 173 are mutually eccentric by the amount of L1. In an initial situation, the machined shoulder 173 and the machined groove 165 in the loading cylinder are in one main direction on the same line with the machined space 166 in the shoe beam, see FIG. 8. In this situation, the whole row of loading cylinders are removed by the distance of L1 in the CD direction of the machine. When the adjusting plate 168 is released and turned by the amount of division angle $\gamma$ between the fastening screws, the center of the loading cylinder moves correspondingly laterally in the direction of the angle $\gamma$ and by the amount of the difference $L1*1-\cos\gamma$ in the direction of the center of machined space 166, see FIG. 8.

The machined shoulder 173 turns about the center of the adjusting plate 166 with the diameter $D=2*L1$. The angle adjustment has maximum values when $\gamma=90°$ or $270°$.

The row of loading cylinders thus moves in relation to the basic adjustment position by $\max\pm L1$ in the longitudinal direction MD of the machine and simultaneously by the amount of L1 in the transverse direction CD of the machine.

In this structural solution, the shoe beam remains immovable in the transverse direction and in the longitudinal direction of the machine while position of the cylinders under the shoe beam changes. During operation, the cylinder can rotate about its axis.

Figure 10:
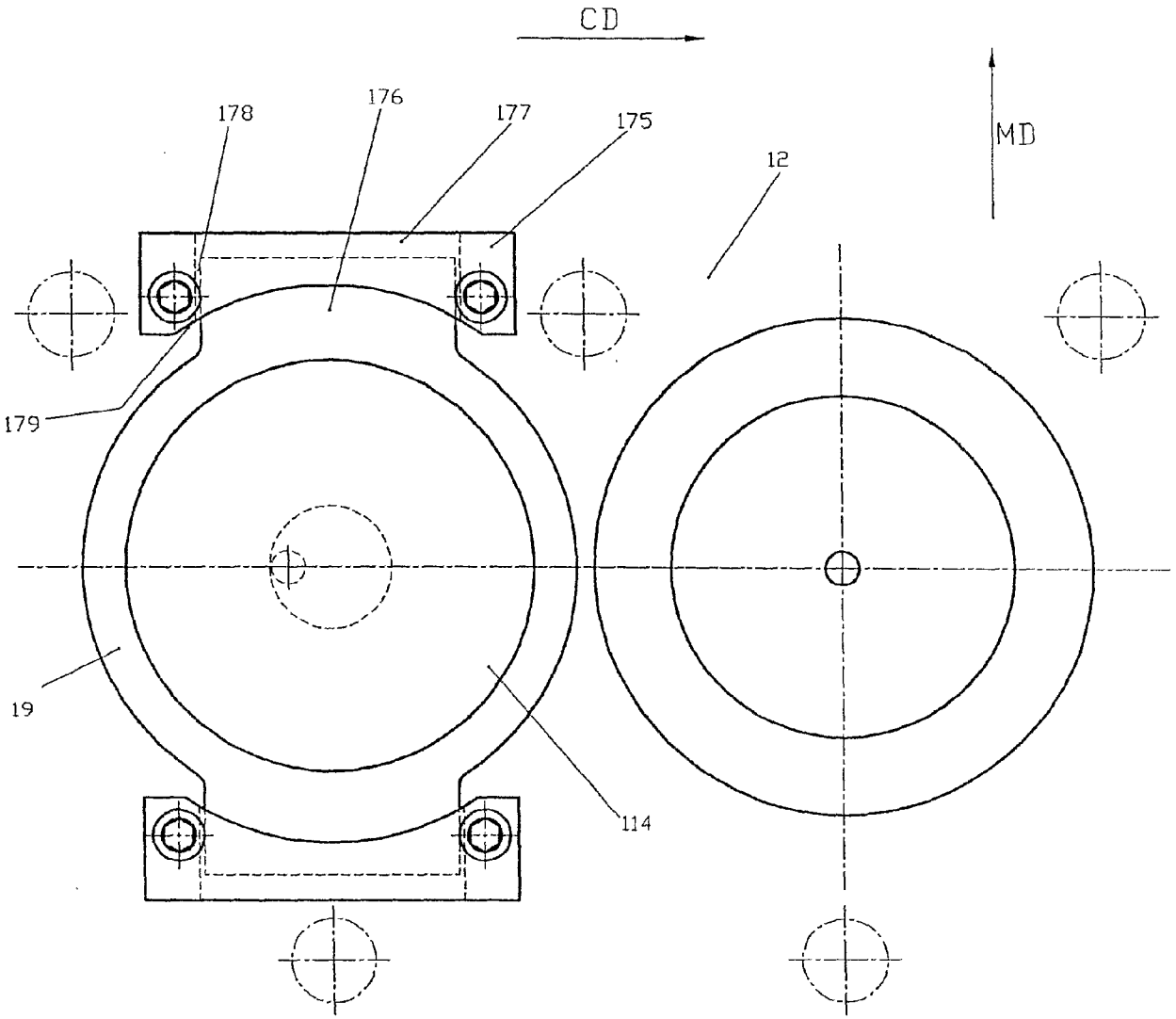
FIG. 10 presents a detail of a loading device provided with a releasing/lifting device according to the second embodiment along line D-D in FIG. 1.
Figure 11:
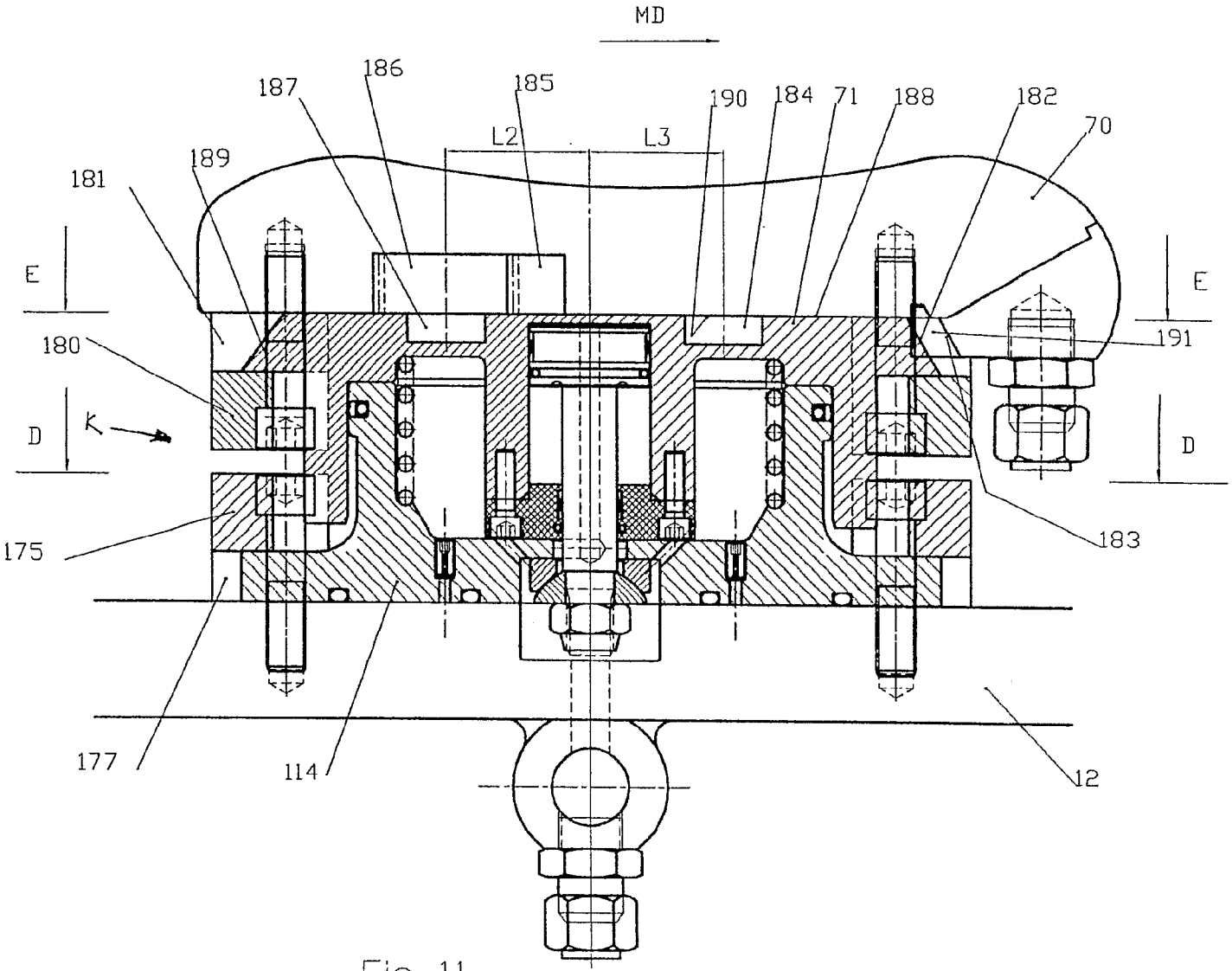
FIG. 11 presents another embodiment of the loading device provided with a releasing/lifting device.

FIG. 10, which is a cross-section D-D of FIG. 11, presents a detail of a more sophisticated solution for movably connecting the cylinder 114 and the supporting beam 12 together. With this structure, a more extensive adjustment range is achieved than with the structure presented in FIG. 6. In its basic structure, bracket 175 is identical to bracket 119, see FIG. 6. The cylinder 114 has additional projecting cams 176, which go under the bracket 175 and, in a lifting situation, are pressed against the bracket 175. The bracket 175 has a space 177 for the cam 176, and likewise a space 178 for thermal expansion between the bracket 175 and the projecting cam 176. The side of the bracket 175 facing towards the cylinder 114 has a curved shape, and it has been machined with radius larger than the flange 19, taking thermal expansion tolerances into account. Like bracket 119, bracket 175 is fastened to the supporting beam 12 with screws as described in FIG. 4.

FIG. 11 presents a second embodiment of the release cylinder of a shoe press that simultaneously functions as a loading cylinder as well. Added to the cylinder part 71 are projecting cams 189, and likewise to the piston part 114. The projecting cams 189 go into a space 181 in the bracket 180 below the shoe beam 70. On the side facing towards the oil supply channel, the projecting cam 189 is beveled to an oblique shape according to surface 182. Correspondingly, the cover part of the oil supply channel is beveled in the area of the projecting cam to an oblique shape according to surface 183. Thus, between surfaces 182,183 there is formed a space 191 that allows the cylinder 71 to move in a lateral direction MD. On the upper surface 188 of the cylinder 71 are two machined oval grooves L2, L3 at different distances in the CD direction of the machine. Thus, by turning the cylinder through 180° about its center, the center of the cylinder is caused to move through a distance corresponding to the difference between amounts L2 and L3 in a desired direction in the MD direction of the machine, in other words, a second basic adjustment is achieved.

In space 184 is set a toothed wheel pin 187, which is eccentric relative to the center of the toothed wheel 186. Placed contiguously with the toothed wheel 186 is a toothed rack 185. By turning the toothed wheel through 180°, the cylinder 71 can be moved further via automatic adjustment by 2*the eccentricity of the toothed wheel in the MD direction of the machine. According to an embodiment, the total movement can be selected between ±0-20 mm.

Figure 12:
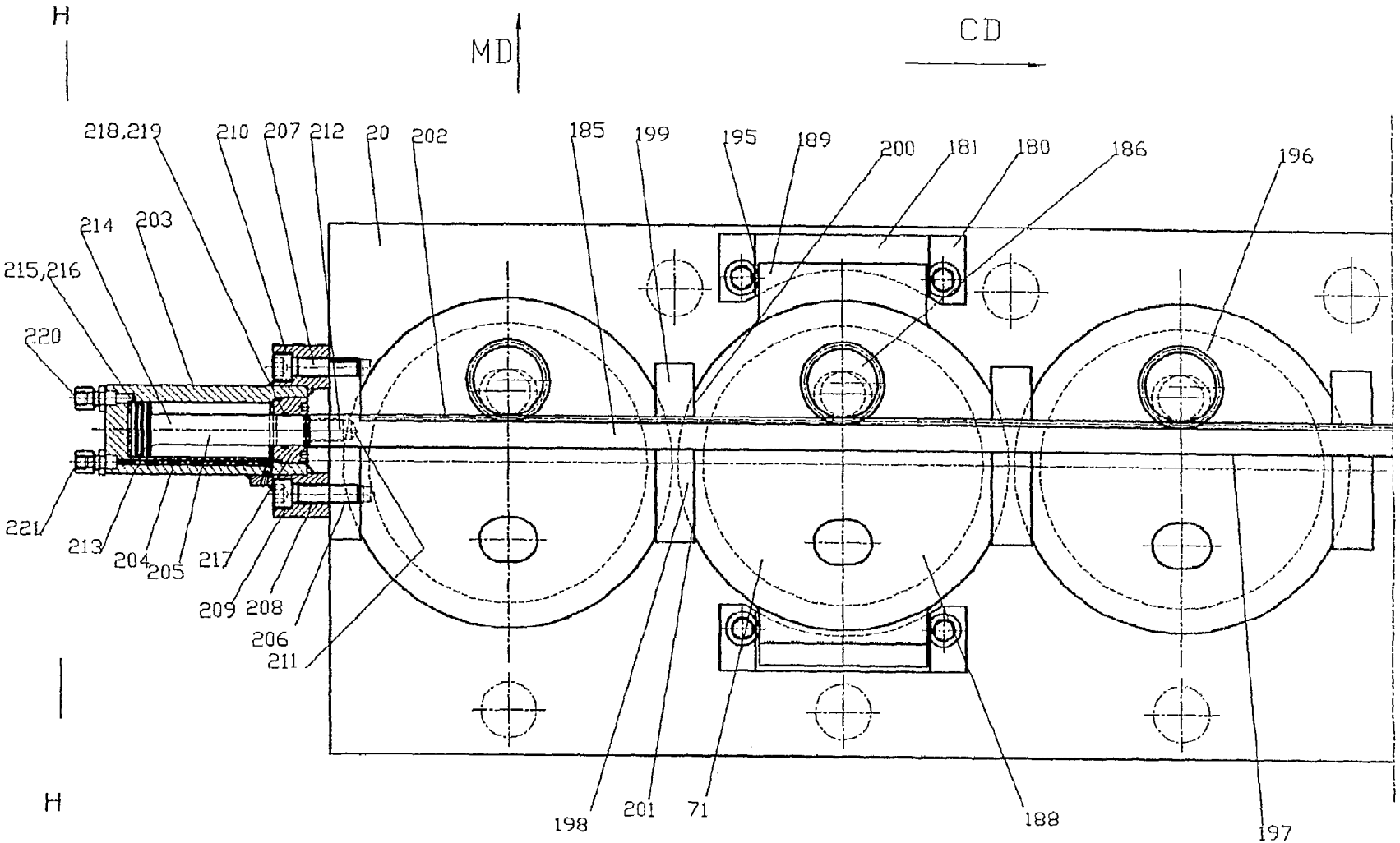
FIG. 12 presents the loading device sectioned along line E-E in FIG. 11, FIGS. 13*a*) and 13*b*) present a loading shoe in side view, as seen from the direction of the machine MD, FIGS. 14*a*) and 14*b*) present a detail of an embodiment of the loading cylinder in different positions inside the shoe beam, FIGS. 15 *a*) and 15 *b*) present a detail of another embodiment of the loading cylinder in different positions inside the shoe beam.

FIG. 12 presents a more detailed cross-section E-E of FIG. 11. It can be seen from the structure that the basic solution is similar to the fastening of the piston 114 to the supporting beam 12, see FIG. 10. Between the projecting cam 189 of the cylinder 71 and the bracket 180, a space 195 is provided to allow for thermal expansion. On the lower surface 190 of the shoe beam, see FIG. 11, a machined space 197 is provided for the toothed rack 185 and the toothed wheel 187. The toothed rack 185 moves in the groove 197 in the CD direction of the machine and is supported by its lateral surfaces on space 197 and on the upper surface 188 of the cylinder 71, and similarly the toothed wheel 186 rotates in space 196 according to the movement of the toothed rack 185 and is supported by its lateral surfaces on space 196 and on the upper surface 188 of the cylinder 71. Machined guides 198 have been machined away from the upper surface 188 of the cylinder 71, and the cylinder 71 is guided by the lateral surface 201 of the machined guide 198 according to surface 200.

The cylinder 71 has two identical guide surfaces 201, so the guiding motion in the MD direction takes place between the two guide surfaces in the direction determined by the toothed rack 185 and the toothed wheel 186. The wedge machining 199 may be machined directly in the shoe beam or it may be made using a separate wedge solution. It is also possible to shape the upper end of the cylinder in such a way that the cylinder itself will act as a wedge element, in which case the shoe beam has a wide wedge machining machined on its bottom.

Part of the toothing 202 of the toothed rack has been removed from between the cylinders, not shown in the figure. This ensures that the distribution of the cylinders will not change in the CD direction of the machine and the tooth pitch will not change the mutual distance of the cylinders.

The toothed rack 185 is moved in the CD direction of the machine automatically by means of a cylinder 203. The cylinder 203 consists of an actual cylinder tube 204 and a piston 205. The shoe beam 70 is provided with threaded holes 206 for the fastening bolts 207 of the cylinder. The mounting flange 210 is provided with clearance holes 208 and counterborings 209 for the fastening bolts 207. The cylinder 204 comprises the mounting flange 210, too, either as a welded structure or an assembly made in some other way.

The end of the toothed rack 185 is provided with a threaded hole 211 and correspondingly the second end of the piston 205 is provided with a fastening thread 212, by means of which the piston 205 is locked to the toothed rack 185. The piston 205 consists of a piston part 213 and a rod 214. At the second end of the rod is the aforesaid fastening thread 212. The rod has additionally a width across flats, not shown in the figure. The piston part 213 is provided with a sealing groove 215 and a seal 216.

Inside the cylinder 204 is a cover part 217 with a threaded outer surface and inside the cover on the side of the piston rod 214 a sealing groove 218 and a seal 219.

The conduit for the supply of pressurized oil to the back side of the piston 213 is referred to by number 220 and the conduit to the front side by 221. Inside the cylinder are additionally the required channel bores and pluggings of additional bores, as well as venting conduits, not shown in the figure. At the other end of the shoe beam is a corresponding transfer system, as can be seen from the figure.

The operating principle is that the cylinder at one end pushes the toothed rack while the cylinder at the other end correspondingly pulls the toothed rack in the direction desired in each situation. As a result of the movement, the toothed wheel rotates in its housing and moves the cylinder in one direction or the other in the MD direction of the machine in relation to the shoe beam. The shoe beam always remains immovable but the cylinder moves. This motion takes place in an unloaded state and the cylinder is, however, lifted by a separate pressure system so that it rests on an oil film. The system also permits other operating variants and is not exclusively limited to the described mode of operation.

Figure 13:
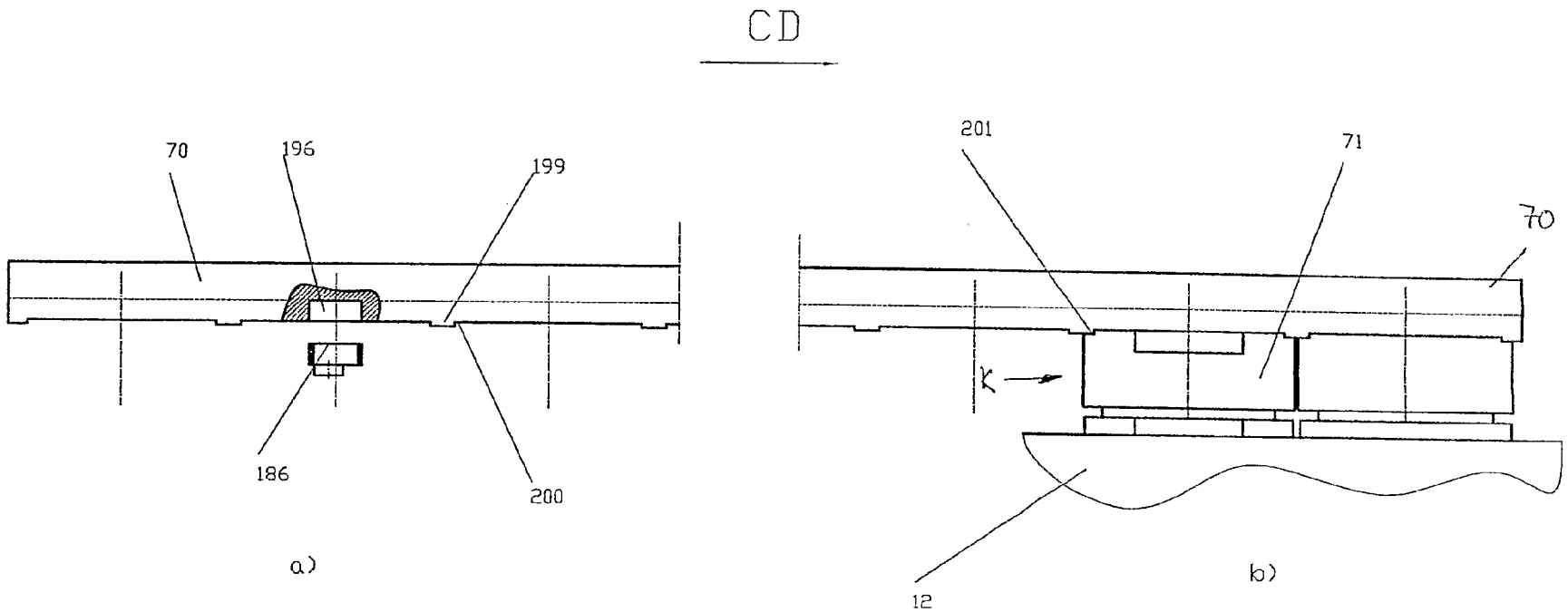

According to FIG. 13 *a* and 13 *b*, the lower surface of the shoe beam 70 is provided with wedge machinings 199 between each cylinder. The side surface 200 of the wedge machining 199 goes against the surface 201 of the cylinder 71. FIG. 13 *a* shows the toothed wheel 186 as a detached part, as well as the space 196 in the lower surface 190 of the shoe to beam 70 where the toothed wheel 186 rotates. The wedge machinings 199 can also be implemented as an actual wedge/screw joint. In this case, the bottom of the shoe beam is first machined to make it straight and only then are the actual wedge slots and the threads for the fastening screws machined.

FIG. 13 *b* shows the situation above the supporting beam 12 as seen from the side of the shoe. The cylinders are placed between the wedge machinings and follow the thermal motion of the shoe beam in the CD direction of the machines. As they are moving, the cylinders move the pistons on the supporting beam with them. The shoe beam is secured by a point on the center line of the machine or by a point in the immediate vicinity of said line. Functionally, the shoe beam can thus expand and move in both directions relative to the center of the machine. In respect of their construction, the normal loading cylinder and the cylinder designed for releasing/lifting only differ from each other in respect of the inner piston and the manner in which they are secured externally.

Figure 14:
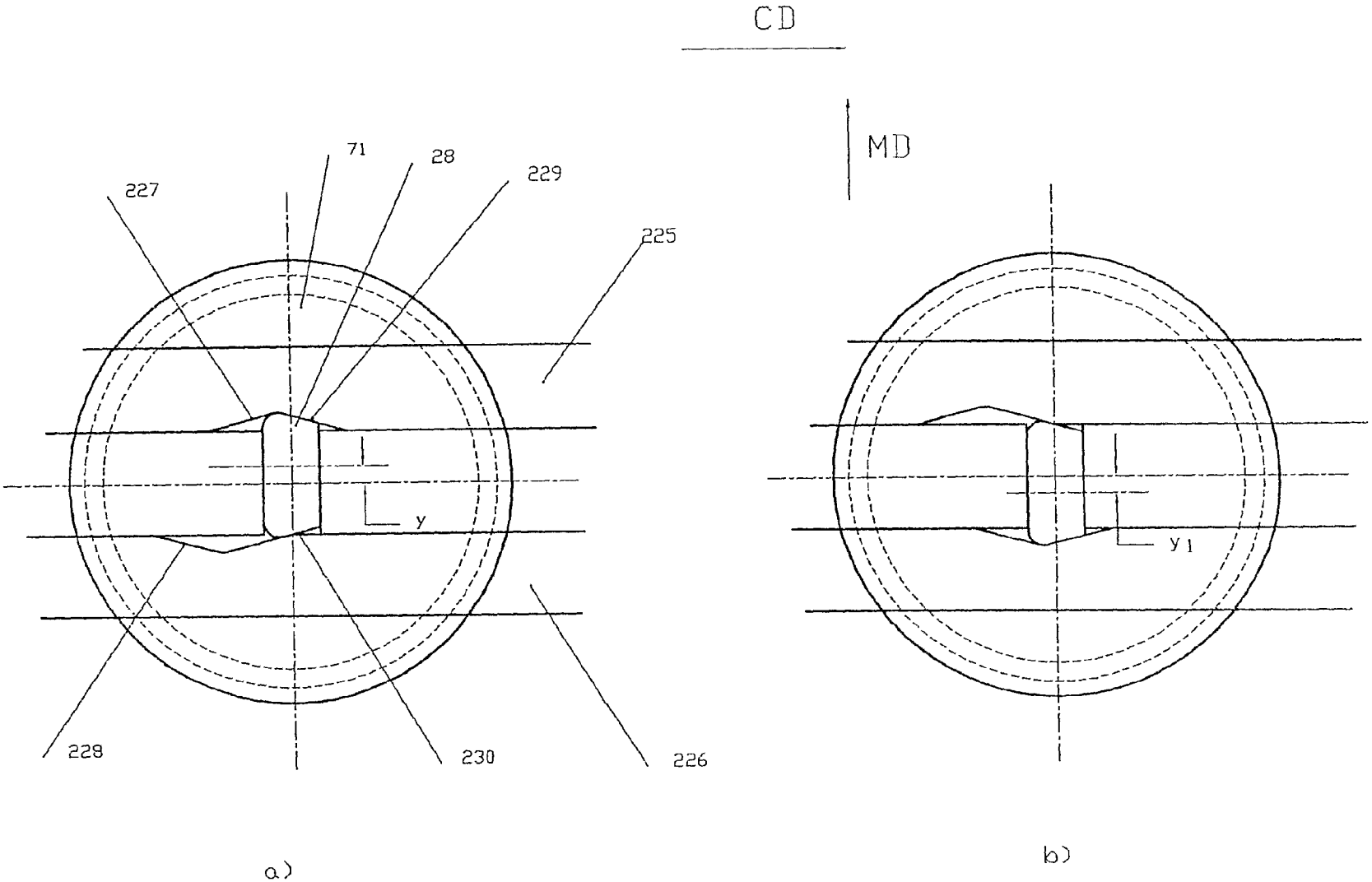

FIG. 14 illustrates an alternative structural solution for bi-directional adjustment of "tilt", wherein the shape of the projection 28 is machined in the way shown in the figure. Surfaces 229,230 are mirror images of each other. In an initial situation, the pull bars/push bars 225,226 are in a position as shown in FIG. 14 *a*, and with a maximum adjustment they are in a position as shown in FIG. 14 *b*. In the initial situation, the cylinder 71 is eccentric relative to the center line CL of the bars 225,226 by the amount of y, and in the final situation on the other side of the center line CL by the amount of y1. In this case, the cylinder 71 thus moves from a higher position towards a lower position in the MD direction of the machine.

The machined guide surfaces 227,228 on the bars 225,226 are as shown in the figure. When the bars 225,226 are being moved in the CD direction of the machine, one to the right and the other correspondingly to the left of the vice versa, one of the machined guide surfaces 227,228 forces the cylinder 71 to move in the desired direction while the other machined guide surface correspondingly makes room on the side of the movement. The action is completely automatic and takes place from the outside of the roll according to control, without a need to dismantle the device. The distance moved through is measured by a linear sensor, not shown in the figure. When the machine is working in normal operation, the linear sensor continuously supplies information about the state of the adjustment and the need to alter the adjustment if for some reason the set adjustment undergoes any change in the MD direction of the machine during operation. For different product qualities, it is possible to find the best position for the shoe beam according to dry matter and other operating parameters and to adjust the beam accordingly before quality change.

In respect of their structure and adjustment properties, the normal cylinder and the releasing/lifting cylinder do not differ from each other. About every 5th cylinder is a lifting/releasing cylinder, unless otherwise required by special reasons.

FIGS. 15*a* and 15*b* further present an alternative structural solution for machining the projection 28 and shows the corresponding side dimensions k and k1, corresponding to values y and y1, see FIG. 14, in bi-directional automatic "tilt adjustment". In other respects the structure corresponds to that described in FIG. 14.

Figure 15:
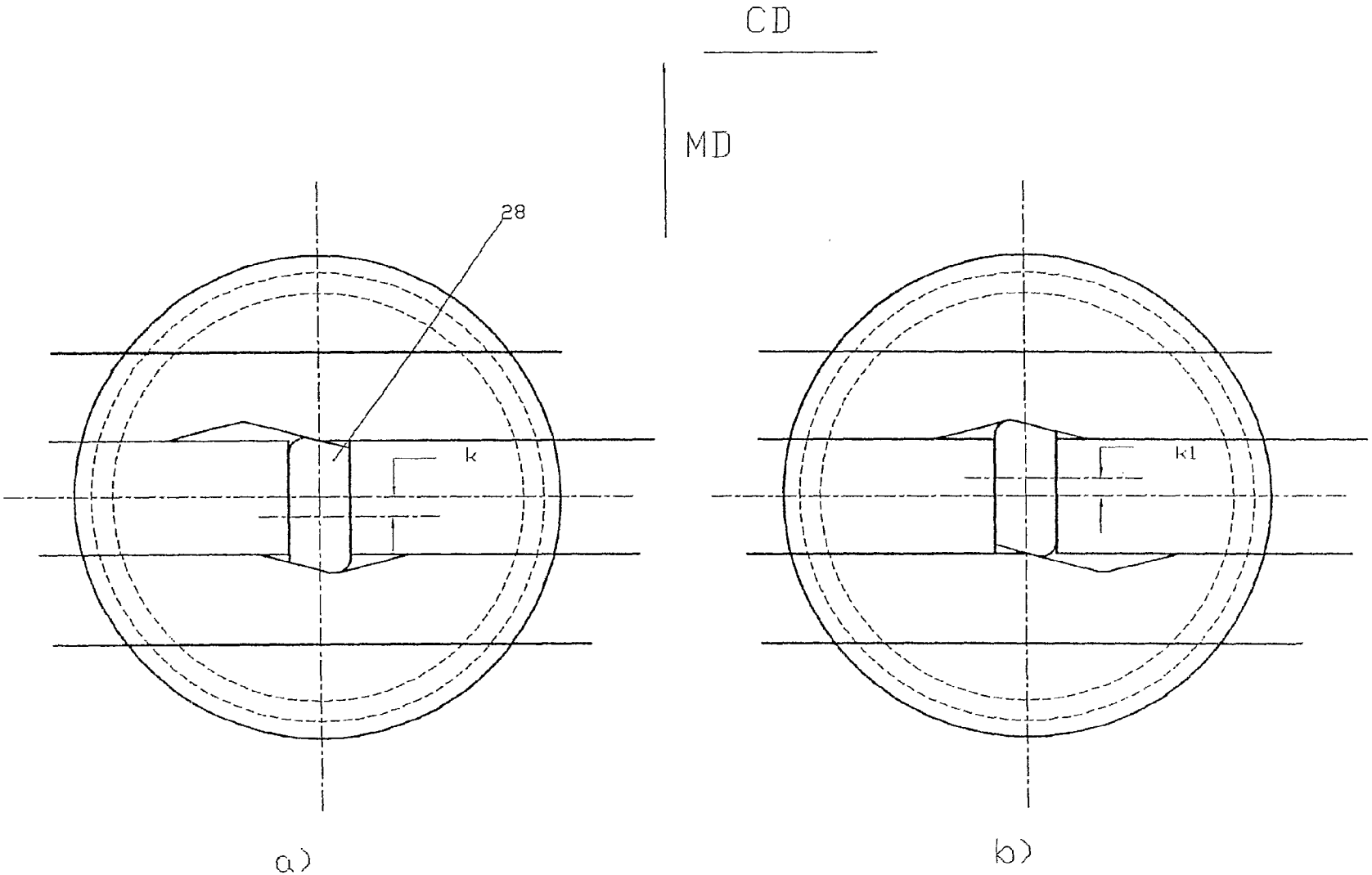
Figure 16:
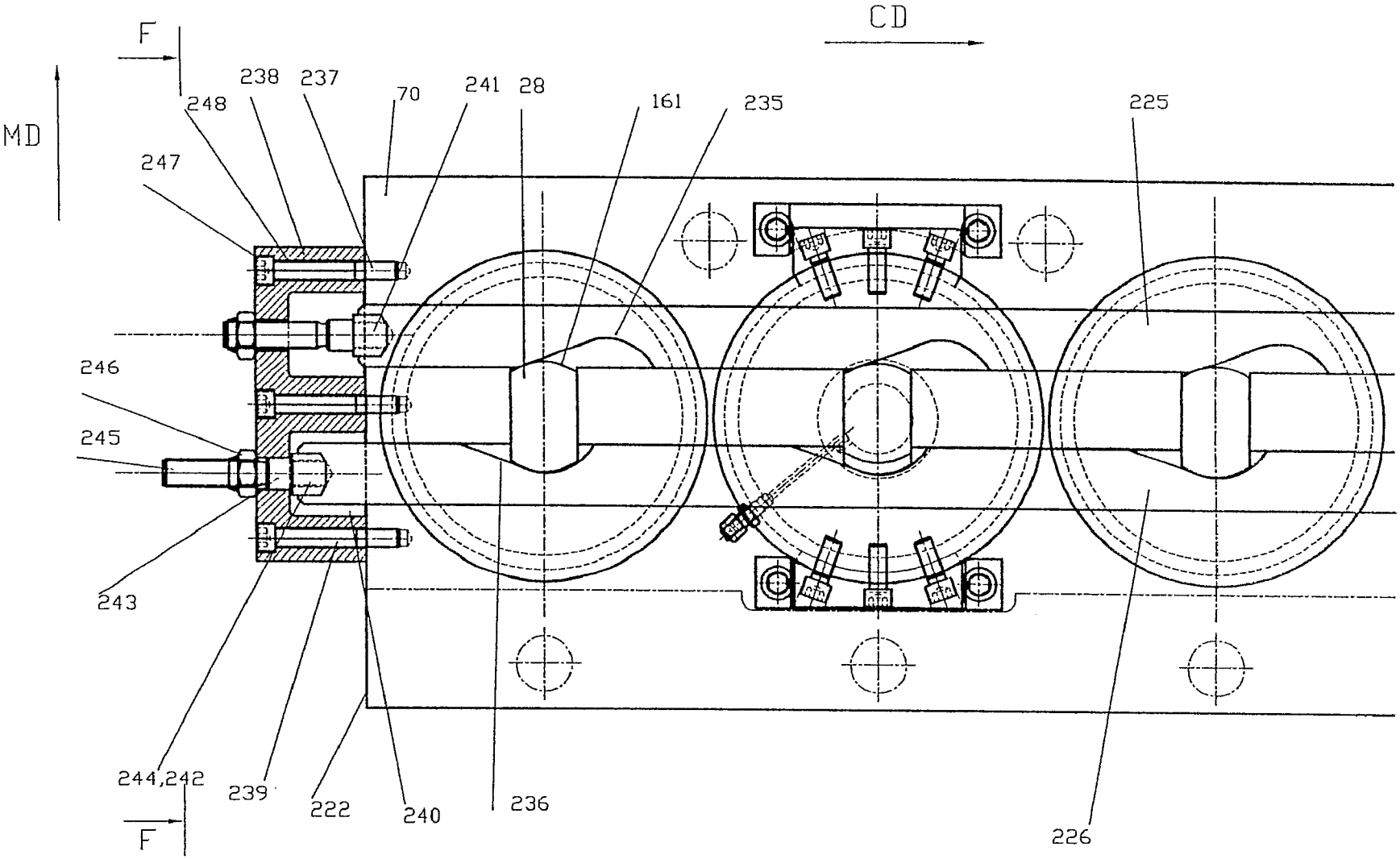
FIG. 16 presents an embodiment of the apparatus of the invention.

FIG. 16 presents a basic solution for manual bi-directional "tilt adjustment". In this case adjustment is only possible when the machine is in standstill state and the surface fabric of the roll removed from the machine. The stop faces of surfaces 161 of the projection 28 are concave surfaces consisting of a straight portion and curved portion, surfaces 235, 236 are mirror images of each other and are placed in somewhat overlapping positions in the CD direction of the machine, as was also described earlier in connection with FIGS. 14 and 15. Curved surfaces 235,236 are the basic solution in the development trajectory while FIGS. 14,15 represent more refined versions of the theme. The later versions have the advantage of a notably large contact surface between the projection 28 and the guide bars 225,226, the surface pressure between the surfaces being thus within allowed limits. The end 222 of the shoe beam 70 is provided with threaded holes 237 for the fastening bolts 239 of an adjusting frame 238. Inside the adjusting frame 238 is a space 240 for the actual adjustment length. The fastening end 241 of the adjusting bars 225, 226 moves in space 240. Inside the fastening end 241 is a threaded hole 242 for the threaded end 244 of an adjusting bolt 243. The other end of the adjusting bolt 243 is correspondingly provided with a thread 245 for adjustment. Actual adjustment is performed by turning the lock nut 246 in the desired direction (loosening or tightening) and correspondingly from the other end of the shoe beam the bar is tightened or loosened by the desired distance by turning the other identical adjusting nut, thus moving the adjusting bar in the CD direction of the machine. In overall adjustment, one of the adjusting bars has to be loosened first and only then is the other one tightened in the opposite direction, thereby moving the row of cylinders in the direction of the loosened bar.

In manual adjustment no separate linear sensor is needed for measuring the distance of sideways movement, unless it is desirable to know this value e.g. for reasons of control to determine how much the center of the cylinder deviates from the nominal center line of the shoe beam. The adjustment can be measured with sufficient accuracy from the length of the portion of the adjusting bolt 243 protruding from the outer surface of the adjusting frame 238. Inside the adjusting frame are counterborings 247 and clearance holes 248 for the fastening bolts 239.

Figure 17:
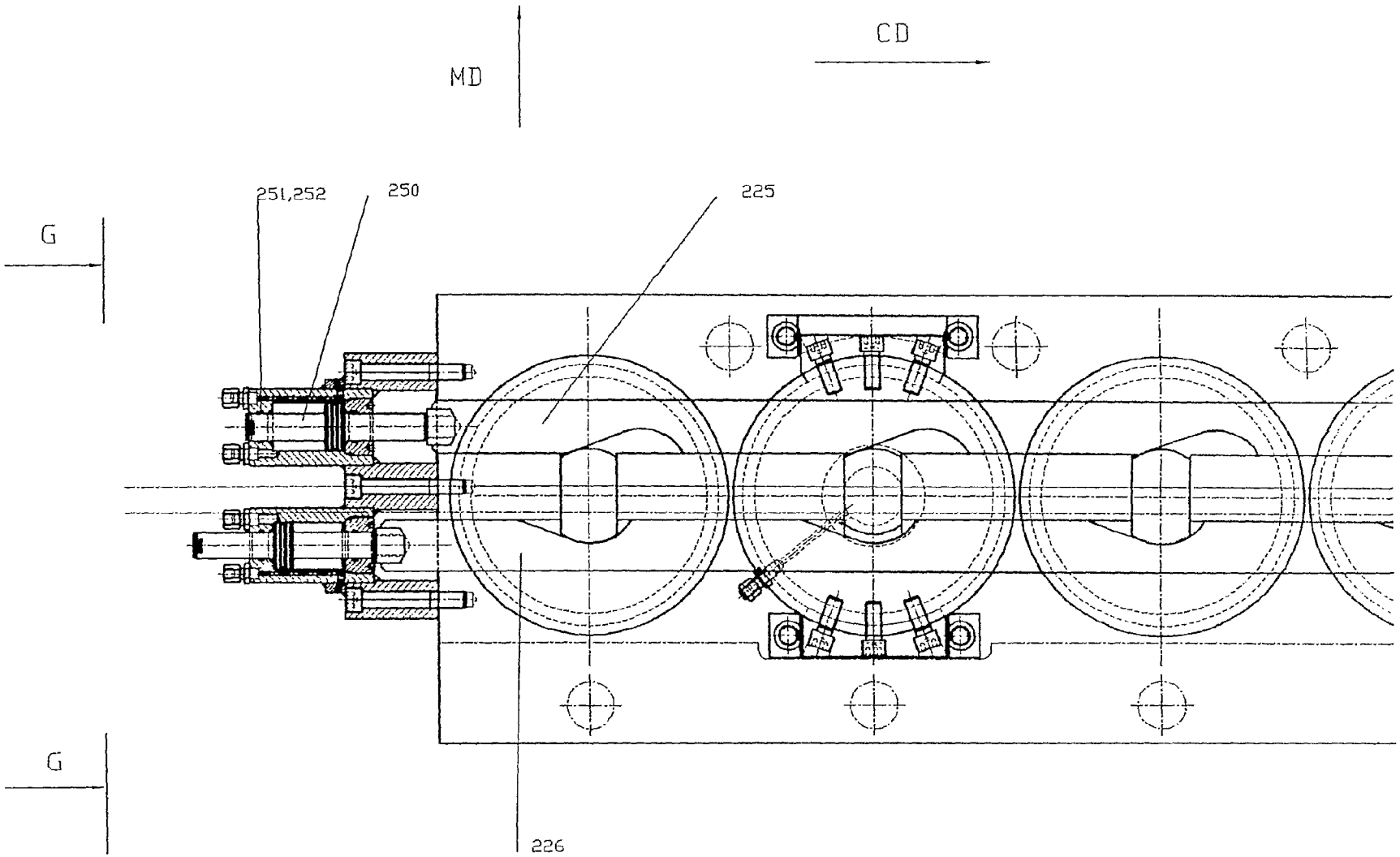
FIG. 17 presents another embodiment of the apparatus of the invention.

FIG. 17 presents a basic solution for automatic bi-directional "tilt adjustment". The structure is in principle identical to the cylinder in FIG. 12. The difference to the structure described above is a second throughgoing piston rod 250 at the second end of the cylinder. In addition, the back end of the cylinder is provided with a sealing groove 251 and a seal 252. The cylinder is fastened to the adjusting bars 225,226 in the same way as in FIG. 16. Identical cylinders acting on the same guide bar are provided at both ends of the shoe beam.

The operation is such that simultaneously one cylinder pair consisting of the pulling and pushing cylinders acting on the same bar moves e.g. bar 225 to the right and correspondingly the other cylinder pair moves bar 226 to the left. The action takes place under hydraulic control. An operating diagram will be presented later on. When the linear sensor, not shown in the figure, measures the desired sideways movement in the MD direction of the machine, the system is locked into a locked state and the flow between different cylinders stops. The adjusting bars 225,226 now remain in their current position, the relevant position data is passed to the machine's logic system or equivalent.

Figure 18:
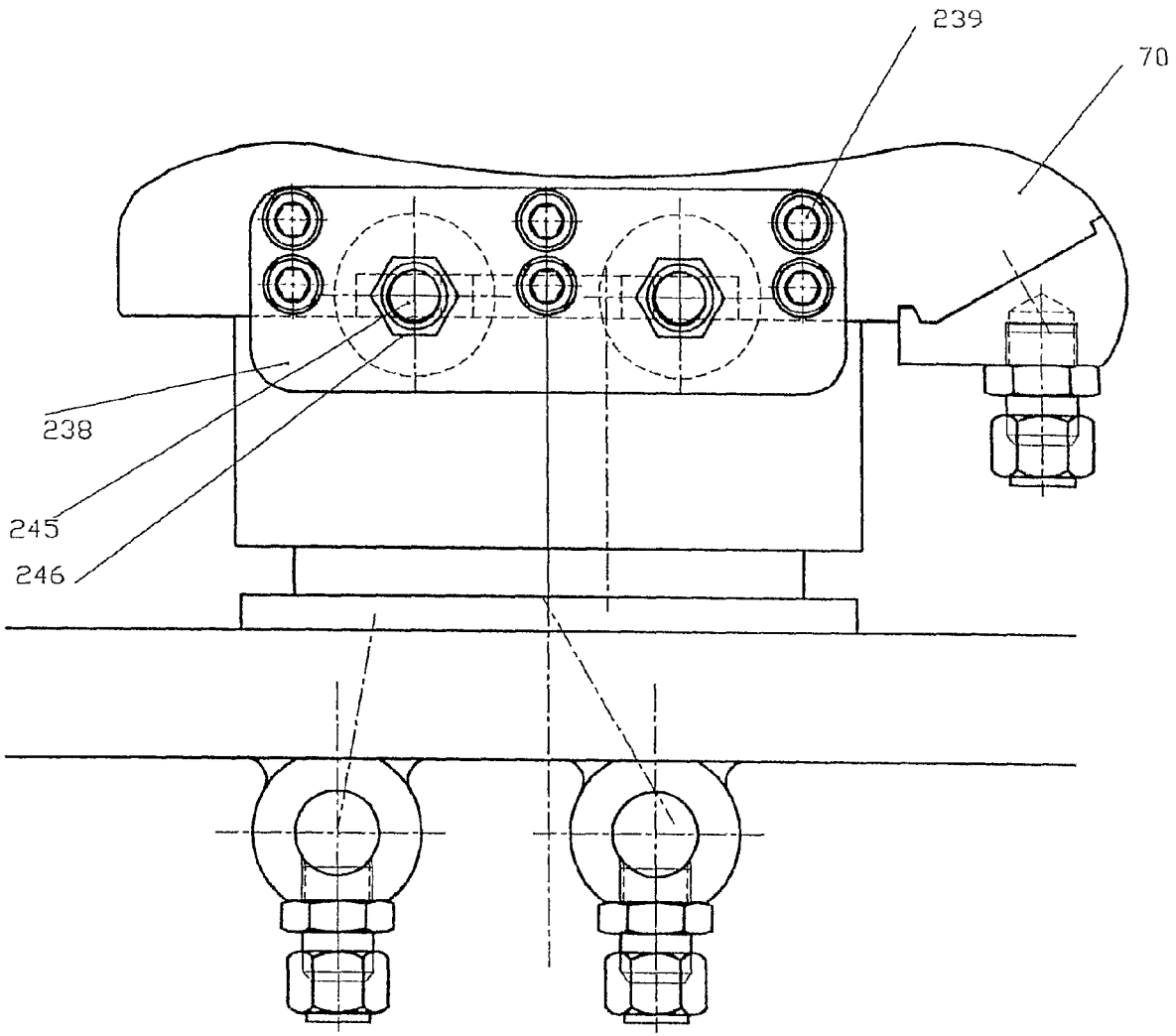
FIG. 18 presents the apparatus of the invention as seen along line F-F in FIG. 16.

FIG. 18 presents a cross-section F-F of FIG. 16, i.e. an end view as seen from the end of the shoe beam. The basic idea in the structure is identical to that in FIG. 20 without automatic adjustment. Generally speaking, a manually adjusted construction is suited for use in applications of simpler technology and can be modified structurally to make it automatically adjustable if necessary.

Figure 19:
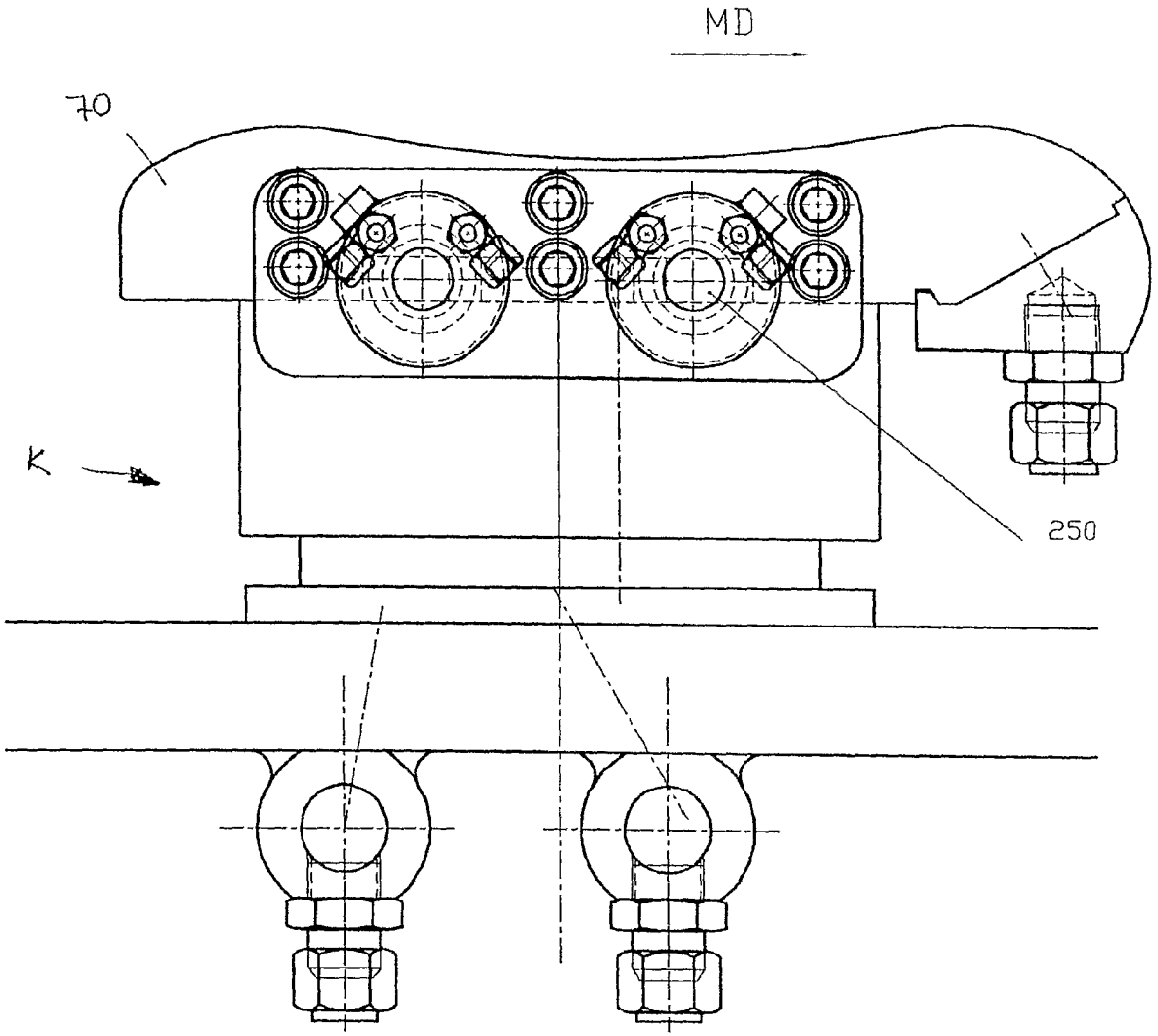
FIG. 19 presents the apparatus of the invention as seen along line G-G in FIG. 17.

FIG. 19 is a cross-section G-G of FIG. 18. It shows a situation as seen from the end of the shoe beam. The construction is in principle identical to that of the manual adjusting device in FIG. 18, and manual adjustment can be replaced with an automatic unit if necessary.

Figure 20:
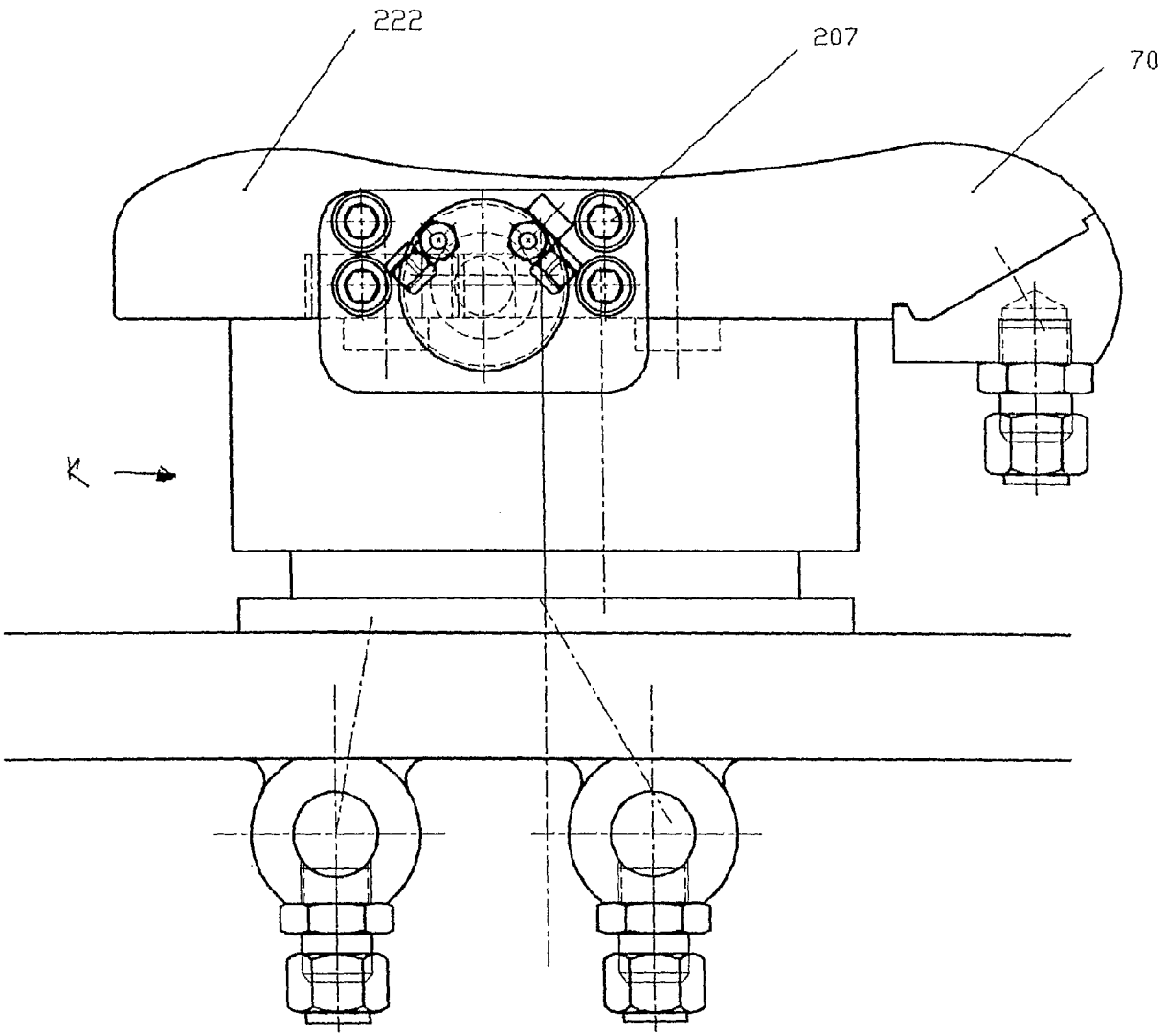
FIG. 20 presents the apparatus of the invention as seen along line H-H in FIG. 12.

FIG. 20 presents a cross-section H-H of FIG. 12, i.e. an end view of the automatic toothed rack/toothed wheel "tilt adjustment". The mounting flange 210 of the cylinder 203 is secured to the end surface 222 of the shoe beam 70. The oil supply conduits are directed in the direction considered best.

Figure 21:
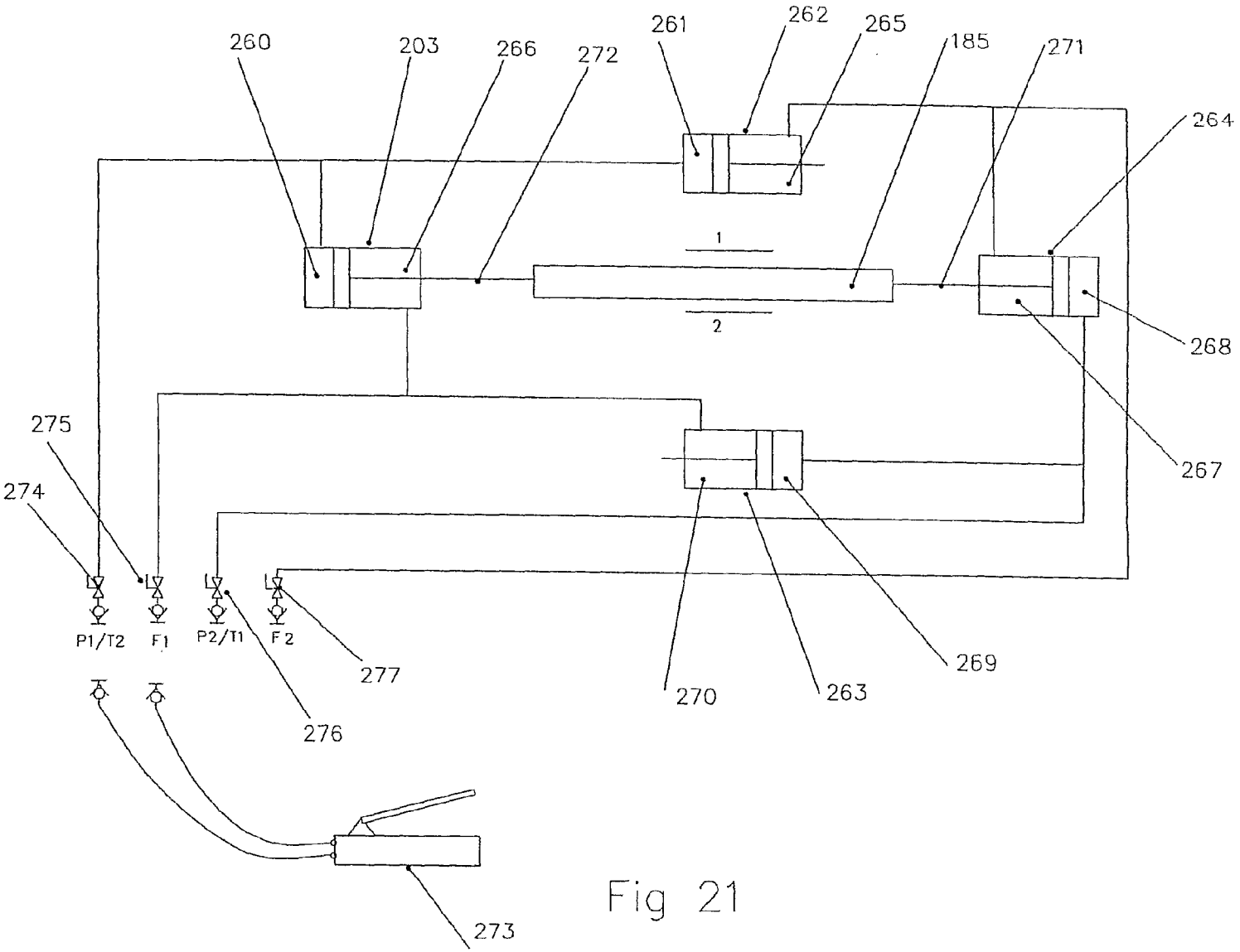
FIG. 21 presents a diagram of an arrangement for controlling the apparatus of the invention.

FIG. 21 presents a diagram illustrating the principle of the hydraulic system in unidirectional automatic "tilt adjustment". Direction 1 corresponds to pressure P1, in this case the movement of the system is to the right in the figure. The cylinders 203,264 are of identical construction and their internal structure is described in FIG. 12. The pressure converters 262,263 are in main principle identical to the cylinders 203, 264, the internal structure is not show. The pressure P1 is conveyed into chambers 260,261, the pressure in chamber 261 increases the pressure in chamber 265 and the pressure increases in chamber 267, corresponding to the pressure in chamber 260 in the proportion of the areas. The pull bar 271 is under the same force as bar 272. From the chambers 266, 270 the overpressure is discharged into a container via conduit F1. From space 268 the pressure is discharged into space 269. During movement 1, conduits P2/T1, F2 and the quick couplings are closed.

Correspondingly, during movement 2, in the figure from right to left, the pressure is passed from conduit P2 into chambers 269,268 and the pressure from space 267,265 is discharged into the tank via conduit F2. From space 270 the pressure is conveyed into space 266. Conduits P1/T2,F1 and the quick couplings are closed. From chamber 260, the pressure is conveyed into space 261. During movement 2, bar 272 is the pulling bar and correspondingly bar 271 is the pushing bar. Position 273 is an oil pump and positions 274,275,276, 277 are shut-off valves. The system allows overall control of forces and pressures at both ends of the toothed rack 185 during movements in different directions.

The diagram only presents a solution with a manual pump, but the external actuator can be completely replaced with an automatic solution and dual-function shut-off valves. Each situation will then be taken care of under control of the automatic system. When the machine is running, the system is shut off in a locked state.

The magnitude of tilt adjustment is obtained as a magnitude of the linear sensor from the automation system.

Figure 22:
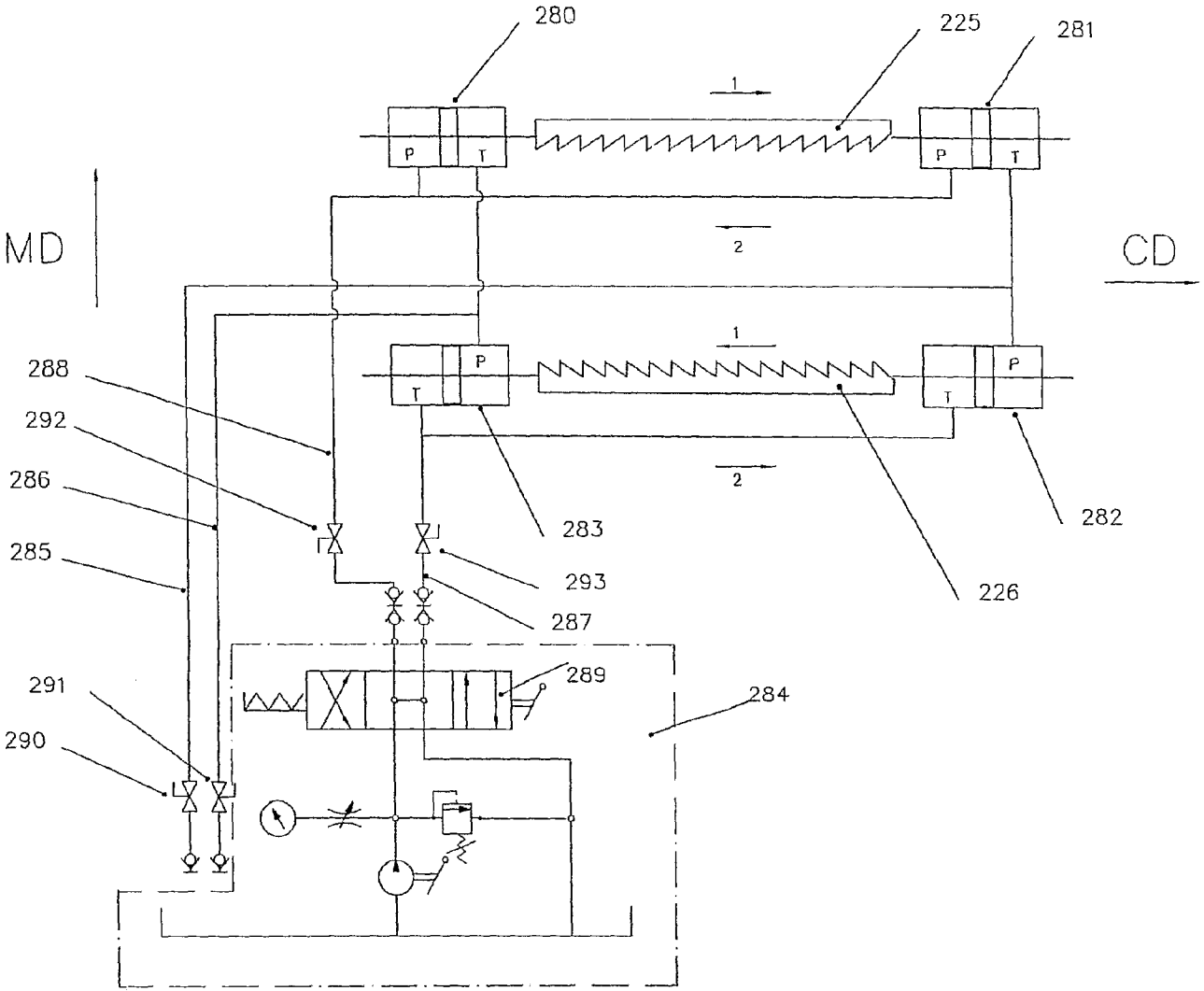
FIG. 22 presents a diagram of an arrangement for controlling the apparatus of the invention.

FIG. 22 presents a diagram showing the main features of bi-directional automatic "tilt adjustment". Cylinders 280,281,282,283 are of a construction identical to that described in FIG. 17. Diagram 284 represents a manually operated pressure unit for the assembly in question, but the pressure unit 284 can also be implemented as a completely automatic unit. If the bars 225,226 are to be moved in the direction of arrow 1, then the pressure is conveyed from the pressure unit 284 into chambers P of cylinders 280,281. As the pressure is increasing on the P side, the pressure on the T side increases correspondingly and thus the pressure is transmitted from the T side of cylinders 280,281 to the P side of cylinders 282,283. Correspondingly, the pressure increases on the T side of cylinders 282,283 and the pressure is discharged via the pressure unit 284 into the container. Since the pistons have equal surface areas, the pressures on different sides of the pistons are correspondingly also equal. Lines 285,286 are needed for internal filling and venting of the structure. If the bars 225,226 are to moved in the direction of arrow 2, then the pressure and tank lines are interchanged in lines 287,288, as a result of which the direction of motion of the bars 225,226 changes. The change of direction is effected by means of valve 289. The required magnitude of tilt adjustment is obtained from the automation system as a setting of the linear sensor. When the machine is in operation, the system is shut off into a locked state and checked if necessary by means of either manually or automatically actuated valves 290,291,292,293. The pressure unit 284 can be either detached from the machine or kept continuously in an operating condition.

By the solution presented in the diagram, the lateral guide bars of the loading cylinders can be caused to move in a desired direction and thus the position of the loading cylinders can be changed in the longitudinal direction MD of the machine in the manner described above.

Typically, the press shoe is supported during the movement by preventing its movement in the machine direction by using a supporting element (not shown in the figures). Supporting elements are typically arranged on opposite sides of the press shoe in the machine direction.

If desirable, the second cylinder-piston unit of the loading unit can also be used to enhance the loading of the shoe press.

It is conceivable that the device of the invention is used in the converse manner so that the adjustment is on the side of the supporting beam and the means for reducing lateral forces are on the side of the press shoe.

It is obvious to the person skilled in the art that the invention is not limited to the embodiments described above, but that it may be varied within the scope of the claims presented below. Depending on the embodiment, features that may have been presented together with other features in the description part can also be used separately from each other.

The invention claimed is:

1. A method for changing a distribution of a loading pressure prevailing in a press nip of a shoe press, which shoe press comprises a number of adjacent loading elements (K) acting on a press shoe (70), a first end of said elements being supported on a supporting beam (12) of the shoe press and another end on the press shoe (70), comprising the following steps:

moving the loading elements (K) in a machine direction (MD) in a space between the press shoe (70) and the supporting beam (12) by acting on the loading element (K) at least at the end adjacent to the press shoe;

arranging at least one transfer element (225, 226, 185) in conjunction with the press shoe (70) wherein the at least one transfer element is moved in a transverse direction (CD) of a machine and by means of which a backing element (28) of the loading element (K) is moved directly or via a transmission mechanism in such a manner that the end adjacent to the press shoe is moved in the machine direction (MD) in relation to the press shoe (70), and that the end of the loading element adjacent to the supporting beam (12) can be caused to freely assume a position in relation to the supporting beam (12), preferably at least during a transfer.

2. A method according to claim 1, characterized in that the loading element is acted on by at least one bar element, which is moved in a transverse direction (CD) of the machine.

3. A method according to claim 1, characterized in that the loading element (K) is acted on via a transmission, wherein an eccentric element acts on the loading element while the eccentric element is acted on by a bar element.

4. A method according to claim 1, characterized in that the loading element is acted on by an eccentric toothed gear, which is rotated by a toothed bar element.

5. A method according to claim 1, characterized in that a projection part (28) formed at the end of the loading element (K) adjacent to the press shoe is moved between guide surfaces (31, 32) extending in the machine direction (MD) while transfer elements laid in the transverse direction of the machine produce a movement in the machine direction (MD).

6. A method according to claim 1, characterized in that a pressure medium is supplied into the space between the supporting beam (12) and the end of the loading element (K) adjacent to the supporting beam to reduce lateral forces.

7. A method according to claim 1, characterized in that the distribution of a loading pressure is adjusted during operation of the machine.

8. A method according to claim 1, characterized in that the distribution of a loading pressure is adjusted continuously on the basis of measurement data.

9. A method according to claim 1, characterized in that the press shoe (70) is acted on by the loading element (K) comprising a cylinder-piston unit.

10. An apparatus for changing a loading pressure prevailing in a press nip of a shoe press, said shoe press comprising a number of adjacent loading elements acting on a press shoe (70), a first end of said elements being supported on a supporting beam (12) of the shoe press and another end on the press shoe (70), comprising:

means for moving at least the end of the loading element (K) adjacent to the press shoe (70) in a machine direction (MD);

wherein the means for moving at least the end of the loading element (K) adjacent to the press shoe (70) includes at least one transfer element (225, 226, 185) arranged in conjunction with the press shoe (70), said at least one transfer element being movable in a transverse direction (CD) of a machine wherein the backing element (28) of the loading element (K) is moved directly or via a transmission mechanism; and means for reducing lateral forces between supporting beam and the end of the loading element adjacent to the supporting beam (12).

11. An apparatus according to claim 10, characterized in that a transfer means moving the loading element (K) comprise actuating devices arranged in or near the end area of the press shoe (70).

12. An apparatus according to claim 10, characterized in that the loading element (K) is a cylinder-piston combination.

13. An apparatus according to claim 10, characterized in that it comprises guide surfaces (31, 32; 200) and/or guide elements (80, 180) arranged in conjunction with the press shoe (70) for guiding the motion of the loading element, especially to make it move in the machine direction (MD).

14. An apparatus according to claim 10, characterized in that the at least one transfer element (225, 226) is provided with a guide surface (227, 228; 235, 236) and the loading device is provided with a mating surface (229, 230, 161) so that the guide surface moves the loading device by the mating surface.

15. An apparatus according to claim 10, characterized in that a transfer means comprise two bar elements (225, 226) which together influence a position of the loading element in the machine direction (MD).

16. An apparatus according to claim 10, characterized in that a transfer means consist of an eccentric wheel, an eccentric toothed gear (186), which is driven by a toothed bar element (185) connected to actuating devices.

17. An apparatus according to claim 10, characterized in that the means for reducing the lateral forces between the supporting beam (12) and the loading element (K) end adjacent to the supporting beam comprise at least one conduit (C3, 22) for conveying a pressure medium into the space between the supporting beam (12) and the loading element (K).

18. An apparatus according to claim 10, characterized in that adjusting devices are arranged in a space formed in the press shoe (K).

* * * * *